US007420579B2

(12) United States Patent
Ueda et al.

(10) Patent No.: US 7,420,579 B2
(45) Date of Patent: Sep. 2, 2008

(54) PRINTER

(75) Inventors: Masahiko Ueda, Musashino (JP); Seiji Morita, Sayama (JP); Yoshinobu Nagasaki, Tachikawa (JP)

(73) Assignee: Citizen Holdings Co., Ltd., Tokyo (JP)

( * ) Notice: Subject to any disclaimer, the term of this patent is extended or adjusted under 35 U.S.C. 154(b) by 485 days.

(21) Appl. No.: 10/563,213

(22) PCT Filed: Jul. 1, 2004

(86) PCT No.: PCT/JP2004/009670

§ 371 (c)(1),
(2), (4) Date: Jan. 3, 2006

(87) PCT Pub. No.: WO2005/002865

PCT Pub. Date: Jan. 13, 2005

(65) Prior Publication Data

US 2006/0216092 A1 Sep. 28, 2006

(30) Foreign Application Priority Data

Jul. 1, 2003 (JP) ..... 2003-189913
Jul. 7, 2003 (JP) ..... 2003-193172

(51) Int. Cl.
*B41J 11/42* (2006.01)
*B41J 25/34* (2006.01)

(52) U.S. Cl. ..... 347/222; 347/197; 347/198; 400/120.16; 400/120.17

(58) Field of Classification Search ..... 347/104, 347/108, 177, 197, 222, 263, 198; 400/120.16, 400/120.17
See application file for complete search history.

(56) References Cited

U.S. PATENT DOCUMENTS

| | | | | |
|---|---|---|---|---|
| 5,570,962 | A | 11/1996 | Suzuki et al. | |
| 5,988,905 | A * | 11/1999 | Abe et al. | 400/613 |
| 6,053,648 | A * | 4/2000 | Mistyurik | 400/693 |
| 6,232,996 | B1 * | 5/2001 | Takahashi et al. | 347/222 |
| 6,682,168 | B2 | 1/2004 | Nakagawa et al. | |
| 2001/0005216 | A1 | 6/2001 | Takahashi et al. | |
| 2006/0023174 | A1 | 2/2006 | Kang et al. | |

FOREIGN PATENT DOCUMENTS

JP 3-23443 3/1991

(Continued)

OTHER PUBLICATIONS

Japan Patent 2000-71533A.*

(Continued)

*Primary Examiner*—Daniel J. Colilla
*Assistant Examiner*—Joseph M Weissman
(74) *Attorney, Agent, or Firm*—Jordan and Hamburg LLP

(57) ABSTRACT

A head unit (200) and a sensor unit (300) are freely Rotatably mounted in a printer main body (100). A rod-shaped portion (320) is projectingly provided to the tip portion of the sensor unit (300), and a first catching portion is provided to the rod-shaped portion (320). Furthermore, a first fixing member (220) is provided to the tip portion of the head unit (200), and the first fixing member (220) is freely detachably fitted to the first catching portion.

18 Claims, 19 Drawing Sheets

FOREIGN PATENT DOCUMENTS

| | | | |
|---|---|---|---|
| JP | 03-053962 | | 3/1991 |
| JP | 03-097579 | | 4/1991 |
| JP | 3-270967 | | 12/1991 |
| JP | 06-047982 | | 2/1994 |
| JP | 6-38688 | | 10/1994 |
| JP | 2000-071533 | | 3/2000 |
| JP | 2000-71533 | | 3/2000 |
| JP | 200071533 A | * | 3/2000 |
| JP | 2003-53962 | | 2/2003 |
| JP | 2003-97579 | | 4/2003 |
| JP | 2003-335016 | | 11/2003 |
| JP | 2006-47982 | | 2/2006 |

OTHER PUBLICATIONS

Translation of abstract of Japan Patent 2000-71533A.*
Machine translation of detailed description for Japan Patent 2000-71533A.*

* cited by examiner

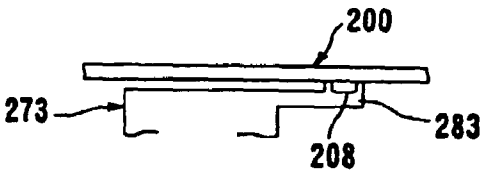
Fig.12C
Fig.12B
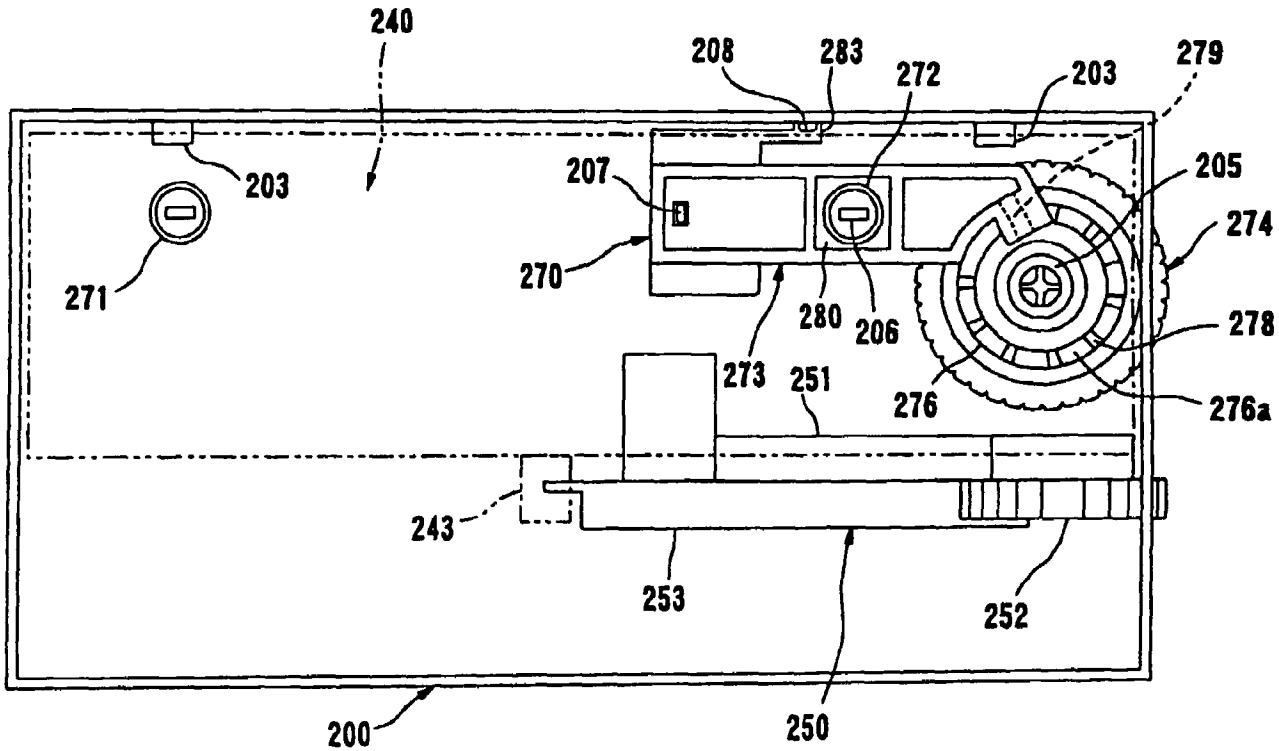
Fig.12A

PRINTER

TECHNICAL FIELD

The present invention relates to a printer equipped with a print head for executing a print operation on a sheet loaded in a printer main body, and a sheet sensor for executing a predetermined detecting operation on the sheet concerned.

BACKGROUND ART

JP-A-2000-71533 discloses a construction that a sensor holder (12) for holding a sheet sensor (13) turns with one end thereof as a fulcrum interlockingly with an opening/closing operation of a holder portion (4) having a print head (8) or the like. A fulcrum portion (15) as a turning fulcrum is provided to one end portion of the sensor holder (12), and a holding shaft (17) is mounted to the other end portion. The holding shaft (17) is engagedly fitted in an elongated hole (22) of a link member (20) connected to the holder portion (4).

Under the state that the holder portion (4) is closed, the sensor holder (12) is disposed in proximity to a sheet feeding passage (10). At this time, the holding shaft (17) is engaged with a holding groove (18) of a holding plate (19) provided to the printer main body (1), and the sensor holder (12) is fixed to the position concerned.

When the holder portion (4) is opened, the engaging state between the holding groove (18) and the holding shaft (17) is released, and also the sensor holder (12) rotates interlockingly around the fulcrum portion (15) and separates from the sheet feeding passage (10).

In the conventional printer having the above-described construction, the holder portion (4) and the sensor holder (12) are connected and integrated with each other by a link member (20), and the sensor holder (12) is separated from the sheet feeding passage (10) interlockingly with the opening operation of the holder portion (4). The sensor holder (12) is also kept to be spaced from the sheet feeding passage (10) while the rink member (20) is opened.

The sheet feeding passage (10) is disposed under the above state. When the sheet concerned has a tendency of curl, it is necessary to manually press the sheet concerned when the sheet is disposed in the sheet feeding passage (10), so that the workability is low.

Furthermore, it is necessary to adjust the position of the sheet sensor (13) in accordance with dimensional change of the sheet. This adjusting work is carried out under the state that the sensor holder (12) is disposed in proximity to the sheet feeding passage (10). JP-A-2000-71533 has no description concerning this adjusting work.

In this type of printer, when the sensor holder (12) is disposed in proximity to the sheet feeding passage (10), the holder portion (4) covers the upper side of the sensor holder (12). Accordingly, it is impossible to manually operate the sheet sensor (13) directly. Therefore, an adjusting mechanism for allowing the sheet sensor (13) to be operated from the outer peripheral portion of the printer main body (1) must be added, and thus the structure is complicated.

Therefore, the present invention has an object to provide a printer in which a sheet can be easily and properly disposed in a printer main body even when the sheet concerned has a tendency of curl, and also a sheet sensor disposed at a detection position can be simply moved and adjusted manually when the dimension of the sheet is changed.

DISCLOSURE OF THE INVENTION

According to the present invention, a printer having a printer main body, a print head for executing a print operation on a sheet loaded in the printer main body, and a sheet sensor for executing a predetermined detecting operation on the sheet, is characterized in that:

the print head is movable between a print position at which the print head is in contact with or in proximity to the sheet and an evacuated position at which the print head is spaced from the sheet;

the sheet sensor is movable between a detection position at which the sheet sensor is in contact with or in proximity to the sheet and a non-detection position at which the sheet sensor is spaced from the sheet; and the sheet sensor is moved from the detection position to the non-detection position interlockingly with a moving operation of the print head from the print position to the evacuated position, and movable from the non-detection position to the detection position independently of the print head.

According to the present invention thus constructed, the sheet sensor is moved from the detection position to the non-detection position interlockingly with the moving operation of the print head from the print position to the evacuated position, and thus the sheet can be easily disposed in the printer main body. Furthermore, the sheet sensor can be moved from the non-detection position to the detection position independently of the print head, and thus even a sheet having a tendency of curl or the like can be held while pressed by the sheet sensor, so that the work of loading the sheet into the printer main body can be more facilitated. In addition, even when the dimension of the sheet is changed, the sheet sensor disposed at the detection position can be manually moved and adjusted simply.

Furthermore, the printer of the present invention can be constructed as follows.

That is, the construction comprises a head unit having a print head mounted therein, and a sensor unit having a sheet sensor mounted therein, a sheet being sandwiched between the sensor unit and a printer main body when the sheet sensor is disposed at a detection position, wherein first engaging means is provided so as to be freely engageable and disengageable between the head unit and the sensor unit, and the sheet sensor is moved from a detection position to a non-detection position interlockingly with a moving operation of the print head from a print position to an evacuated position under the state that the head unit and the sensor unit are engaged with each other by the first engaging means.

Furthermore, second engaging means is further provided so as to be freely engageable and disengageable between the printer main body and the sensor unit, under the state that the print head is disposed at the print position and the sheet sensor is disposed at the detection position, the head unit and the sensor unit are engaged with each other by the first engaging means and the sensor unit and the printer main body are engaged with each other by the second engaging means, and when the print head is moved from the print position to the evacuated position from the state that each of the first and second engaging means carries out the engagement, the engagement state between the sensor unit and the printer main body by the second engaging means is released.

Furthermore, when the print head is moved from the print position to the evacuated position and the engagement state between the sensor unit and the printer main body by the second engaging means is released, the sensor unit is movable from the detection position independently of the head, and is engageable with the printer main body by the second engaging means.

As described above, by moving the sensor unit alone and engagedly holding the sensor unit at the detection position, a sheet having a tendency of curl or the like can be held while pressed by the sensor unit, and the work of loading a sheet into the printer main body can be further facilitated.

Here, the first engaging means may contain a first latch pawl provided to the head unit, and a first catching portion provided to the sensor unit, the first latch pawl being freely engaged with and disengaged from the first catching portion, the second engaging means may contain a second latch pawl provided to the printer main body and a second catching portion provided to the sensor unit, the second latch pawl being freely engaged with and disengaged from the second catching portion, and the latching force of the first latch pawl to the first catching portion may be set to a value larger than the latching force of the second latch pawl to the second catching portion.

The head unit may be designed so that one end thereof is freely rotatably mounted at one side portion of the printer main body, and the first latch pawl is provided to the other end of the head unit.

The sensor unit may be designed so that one end thereof is freely rotatably mounted at one side portion of the printer main body, and the first and second catching portions are provided to the other end of the sensor unit.

The second latch pawl may be provided to the other side portion of the print main body.

Furthermore, the construction may be modified so that a rod-shaped portion is provided to the other end of the sensor unit so as to extend in the axial direction, the first and second catching portions are provided at different positions of the rod-shaped portion, a first recess portion engaged with the rod-shaped portion is provided at the other end of the head unit, a first latch pawl is provided at the inner edge of the first recess portion, a second recess portion with which the rod-shaped portion of the sensor unit is engaged is provided to the other side portion of the printer, a second latch pawl is provided at the inner edge of the second recess portion, and the first and second recess portions are fitted to the rod-shaped portion from the confronting direction.

The above construction may be modified so that one ends of the head unit and the sensor unit are mounted in the printer main body while the rotating centers thereof are displaced from each other, and when the respective units rotates in the same direction interlockingly, the first recess portion is relatively moved along the rod-shaped portion, and the engagement state of the first latch pawl to the first catching portion is released.

In addition, the construction may be further equipped with holding means for holding the sensor unit at the non-detection position. Furthermore, the construction may be further equipped with an urging member for urging the head unit at all times so that the print head is moved from the print position to the evacuated position, and holding the head unit at the evacuated position. In both the cases, it is preferable to further provide braking means for braking the head unit when the print head is moved from the print position to the evacuated position by a predetermined angle or more. The above construction can avoid a risk that the head unit moves with great force and it abuts against an operator.

BRIEF DESCRIPTION OF THE DRAWINGS

FIG. 12A is a bottom view showing a front-and-rear tilt adjusting mechanism and a pressure center point moving mechanism provided to the inner bottom portion of the head unit.

FIG. 12B is an enlarged cross-sectional side view showing a support portion of the head support member.

FIG. 12C is an enlarged bottom view showing a drop-out preventing mechanism of a cam follower serving as a constituent part of the pressure center point moving mechanism.

BEST MODES FOR CARRYING OUT THE INVENTION

Figure 1:
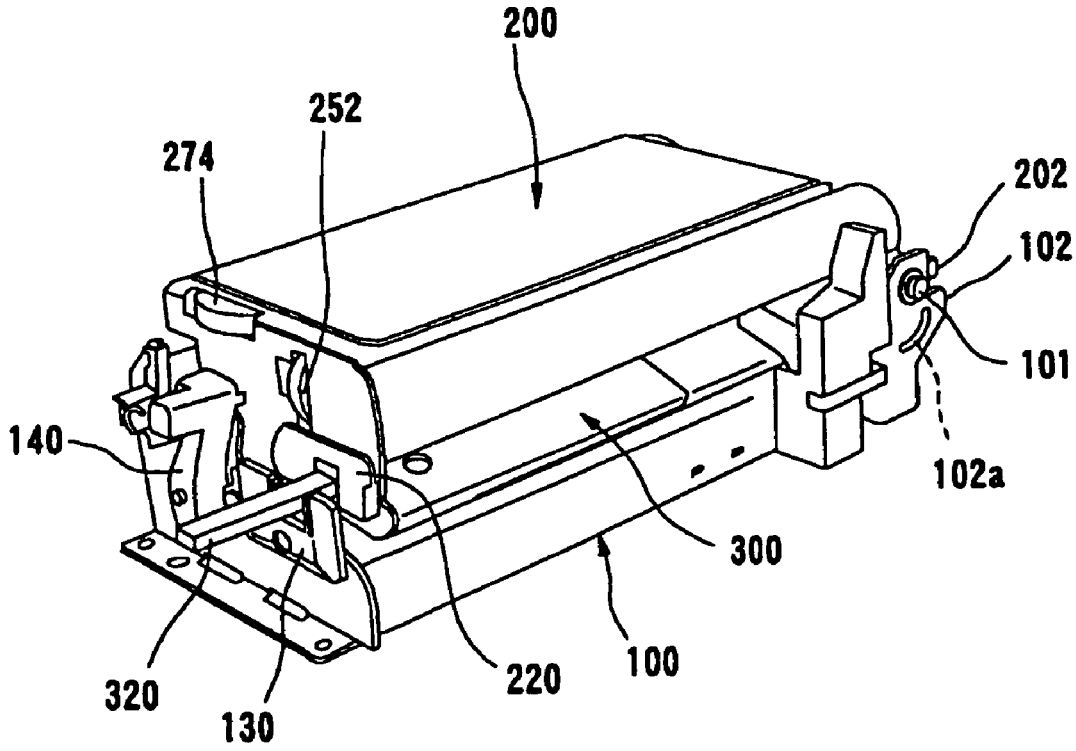
FIGS. 1 to 4 are perspective views showing the outlook of a printer according to an embodiment of the present invention.
Figure 2:
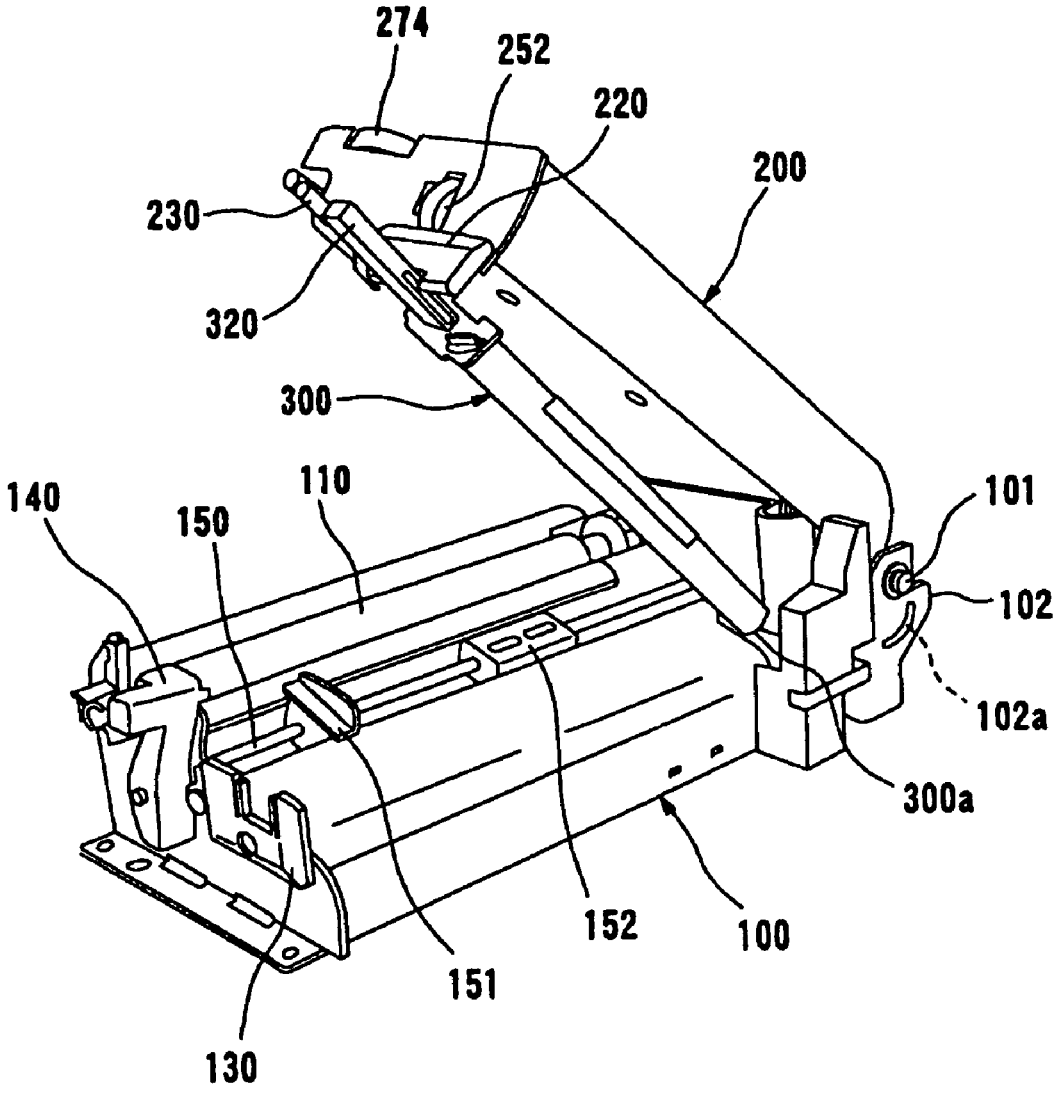

A preferred embodiment according to the present invention will be described with reference to the drawings.

In this embodiment, the present invention is applied to a thermal-sensitive type label printer in which a linear type print head is disposed in the width direction of a sheet.

FIGS. 1 to 4 are perspective views showing the outlook of the printer according to this embodiment.

The printer of this embodiment is equipped with a printer main body 100, a head unit 200 and a sensor unit 300.

The upper surface of the printer main body constitutes a feeding passage for sheets (sheet feeding passage) (for example, see FIG. 3), and a platen 110 serving as a sheet feeding member is mounted on the sheet feeding passage. The platen 110 is a cylindrical constituent part, and an elastic member is engaged with the outer peripheral surface of the platen 110. A sheet is pinched between the platen 110 and a print head 201 described later, and the sheet concerned is fed in connection with rotation of the platen 110.

FIGS. 5A to 7D show the mount structure of the platen.

Figure 5A:
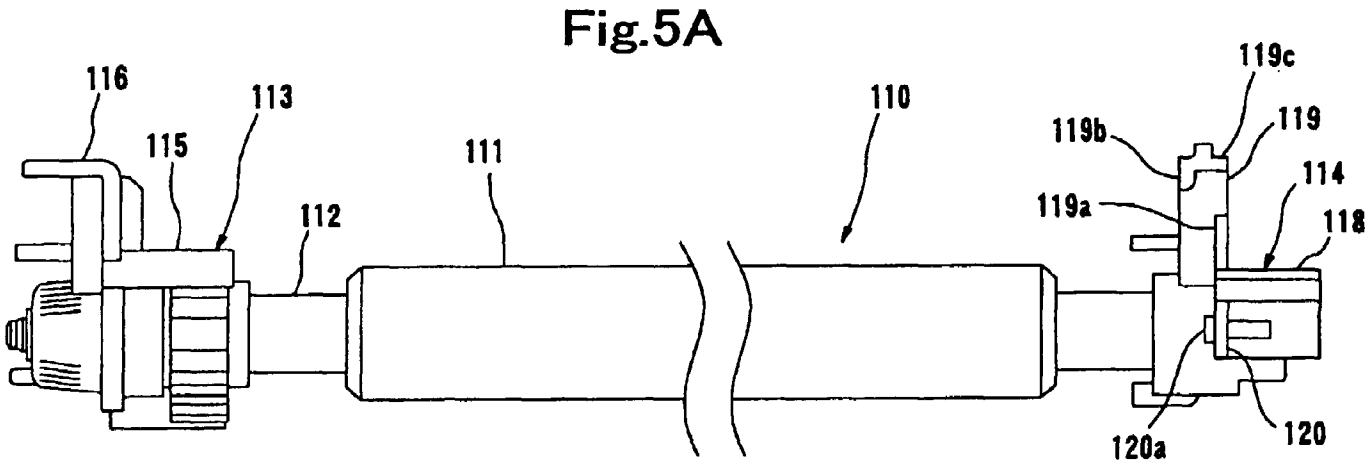
FIG. 5A is a front view showing a partially notched platen.
Figure 5B:
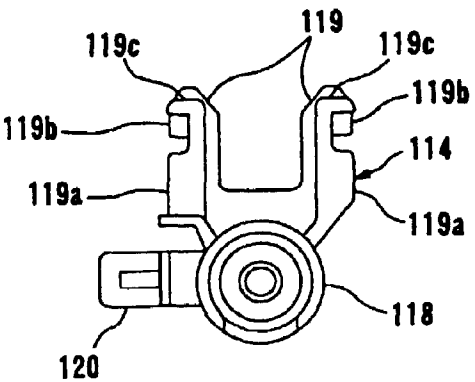
FIG. 5B is a right side view showing the platen.

As shown in FIGS. 5A, 5B, the platen 110 is equipped with an elastic member 111 such as synthetic rubber or the like on the outer periphery of a rotating shaft 112, and bearing members 113, 114 are secured to both the ends of the rotating shaft 112.

The bearing member 113 (the bearing member at the left side of the figure) has a main body portion 115 and a mount wing portion 116. The main body portion 115 supports the rotating shaft 112 at one end thereof so that the rotating shaft 112 is freely rotatable. As not clearly shown in the figures, the mount wind portion 116 extends from the main body portion 115 upwardly like wings, and the mount wing portion 116 is fitted to the platen support portion 117 of the printer main body 100.

Figure 6A:
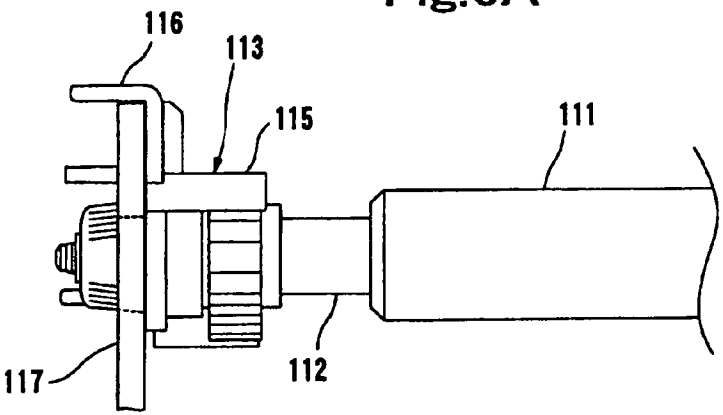
FIG. 6A is an enlarged front view showing a bearing member mounted at tone end of the platen.
Figure 6B:
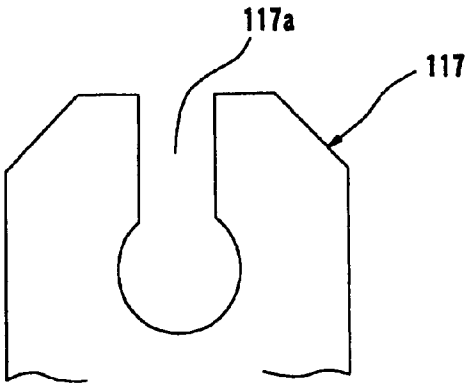
FIG. 6B is a side view showing a platen support portion formed at one side end portion of the printer main body.

As shown in FIGS. 6A, 6B, a platen support portion 117 comprising a cut-out groove 117*a* and a peripheral wall thereof is formed at one side end portion of the printer main body 100 (see FIG. 6B). The formation portion of the platen support portion 117 is designed to have a plate-like shape as shown in FIG. 6A. The bearing member 113 is inserted in the cut-out groove 117*a*, and the lower half peripheral portion of the main body portion 115 is supported by the bottom portion the cut-out groove 1176*a*. At the same time, the mount wing portion 116 is fitted to the inner side portion of the cut-out groove 117*a*, the peripheral wall thereof and the upper edge of the peripheral wall.

Furthermore, the other bearing member 114 (the bearing member at the right side of FIG. 5A) comprises a main body portion 118, a mount wing portion 119 and a fitting piece 120. The main body portion 118 supports the rotating shaft 112 at one end thereof so that the rotating shaft 112 is freely rotatable. As shown in FIG. 5B, the mount wing portion 119 extends from the main body portion 118 upwardly like wings, and the mount wing portion 119 is fitted to the platen support portion 121 of the printer main body 100. The fitting piece 120 extends from the main body portion 118 sideward, and a fitting projection 120*a* protrudes from one end surface of the fitting piece 120.

Figure 7B:
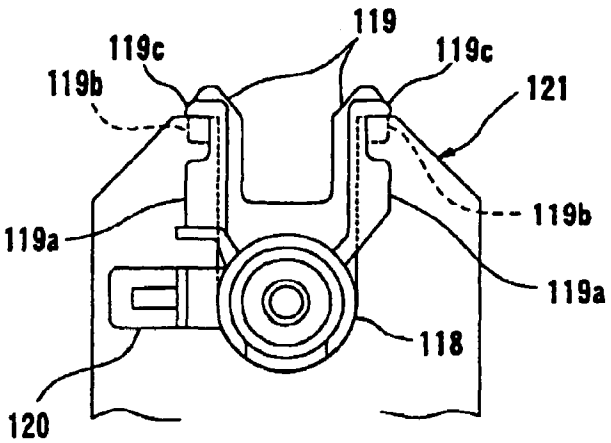
FIG. 7B is an enlarged right side view showing the bearing member mounted at the other end of the platen.
Figure 7C:
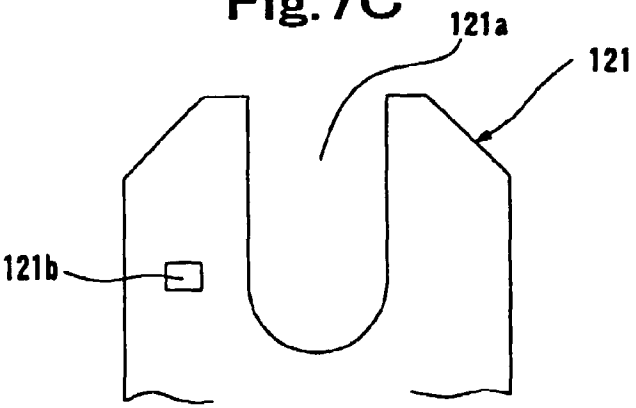
FIG. 7C is a side view showing a platen support portion formed at the other side end portion of the printer main body.
Figure 7A:
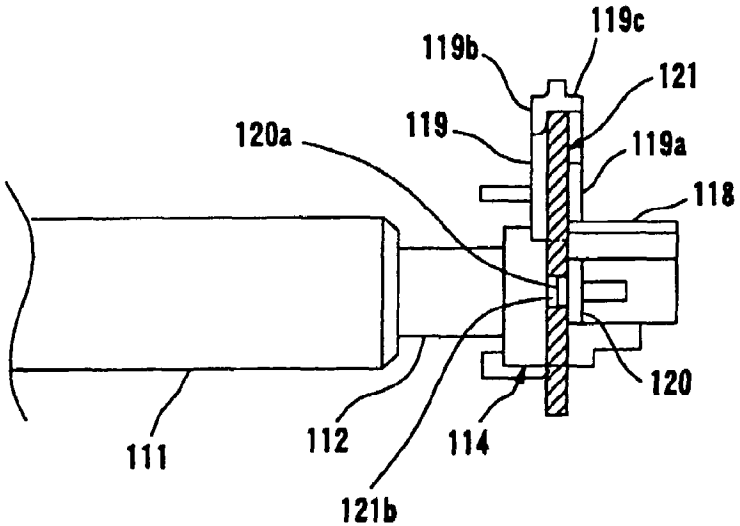
FIG. 7A is an enlarged front view showing a bearing member mounted at the other end of the platen.
Figure 7D:
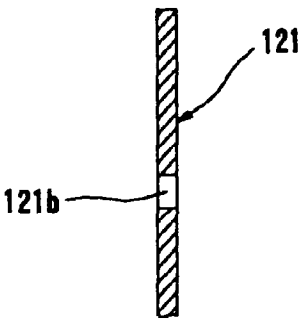
FIG. 7D is a front cross-sectional view showing the platen support portion.

As shown in FIGS. 7A to 7D, a platen support portion 121 comprising a cut-out groove 121*a* and a peripheral wall thereof is provided to the other side end portion of the printer main body 100 (see FIG. 7C). The formation portion of the platen support portion 121 is designed to have a plate-like shape as shown in FIG. 7D. The bearing member 114 is inserted into the cut-out groove 121*a* from the upper side, and the lower half peripheral portion of the main body portion 118 is supported by the bottom portion of the cut-out groove 121*a*. At the same time, the mount wing portion 119 is fitted to the inner side portion of the cut-out groove 121*a* and the peripheral wall.

As shown in FIGS. 7A, 7B, the mount wing portions 119 has outer walls 119*a*, inner walls 119*b* and upper walls 119*c* which are symmetrically disposed at right and left positions, respectively. The outer side wall 119*a* and the inner side wall 119*b* are formed so as to be spaced from each other at the interval corresponding to the thickness of the platen support portion 121. The vertical positions of the outer wall 119*a* and the inner wall 119*b* are set so that the outer wall 119*a* is located at a position lower than the inner wall 119*b*. The upper wall 119*c* is continuous with the upper end of the inner wall 119*b*, and it is formed at an upper position of the intermediate portion between the outer wall 119*a* and the inner wall 119*b*.

The mount wing portion 119 is fitted to the platen support portion 121 so that the peripheral wall of the cut-out groove 121*a* is set in between the outer wall 119*a* and the inner wall 119*b*. The upper wall 119*c* is fitted to the upper end edge of the platen support 121.

A fitting groove 121*b* is formed at a side of the cut-out groove 121*a* of the platen support portion 121, and when the mount wing portion 119 is fitted to the platen support portion 121 as described above, the fitting projection of the fitting piece 120 is fitted in the fitting groove 121*b*, whereby the bearing member 114 is prevented from dropping out of the platen support portion 121.

When the bearing member 114 is detached from the platen support portion 121, it is sufficient only to pull out the fitting projection 120*a* from the fitting groove 121*b* by sagging the fitting piece 120 and then move the bearing member 114 upwardly, whereby the engagement state of the mount wing portion 119 with the platen support portion 121 is released.

According to the mount structure of the platen 110 described above, no specific tool is needed, and the platen 110 is freely detachably mounted in the printer main body 100, so that excellent maintenance performance can be secured.

Returning to FIGS. 1 to 4, the constructions of the head unit 200 and the sensor unit 300 will be described again.

Figure 3:
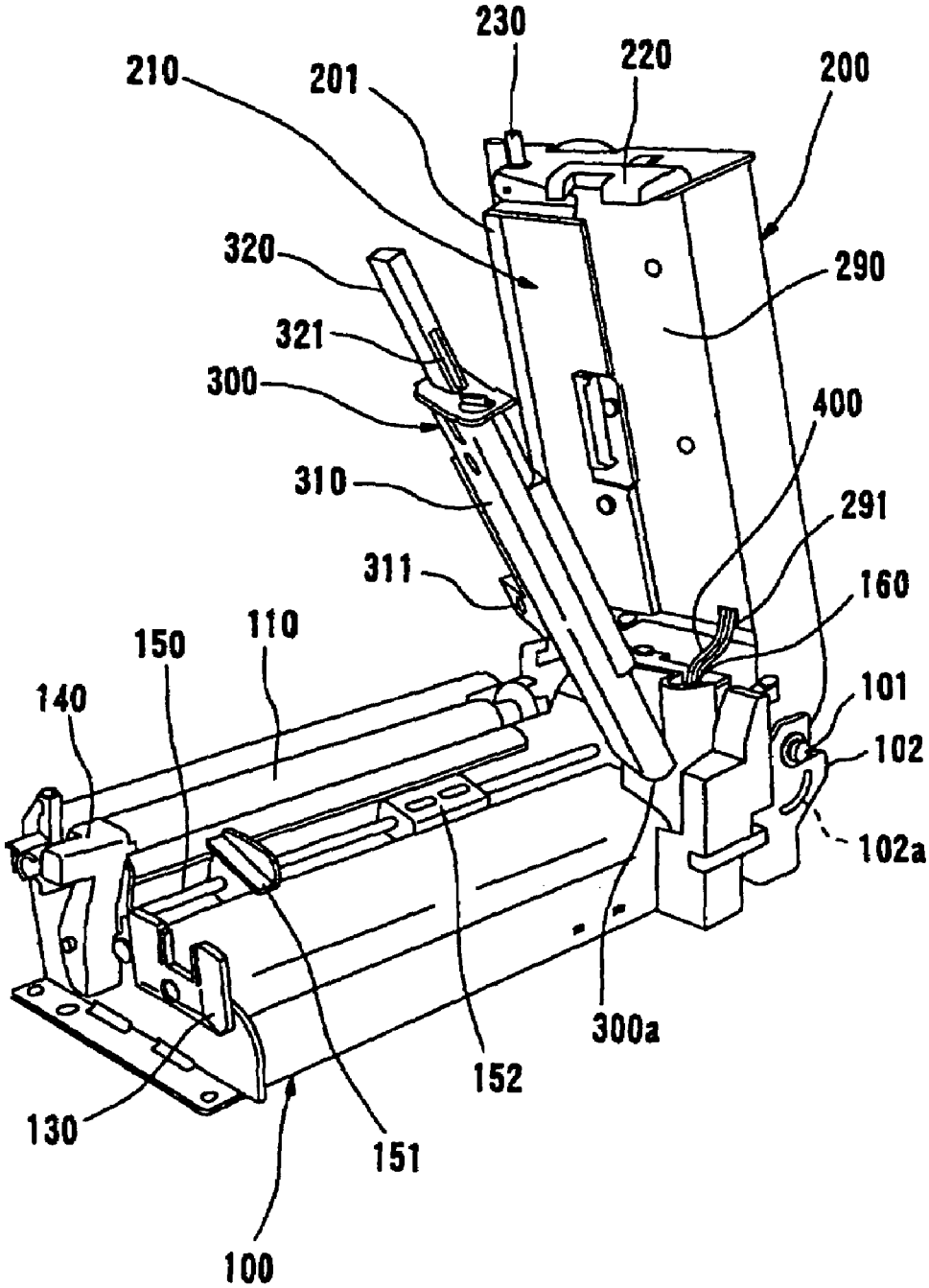
Figure 4:
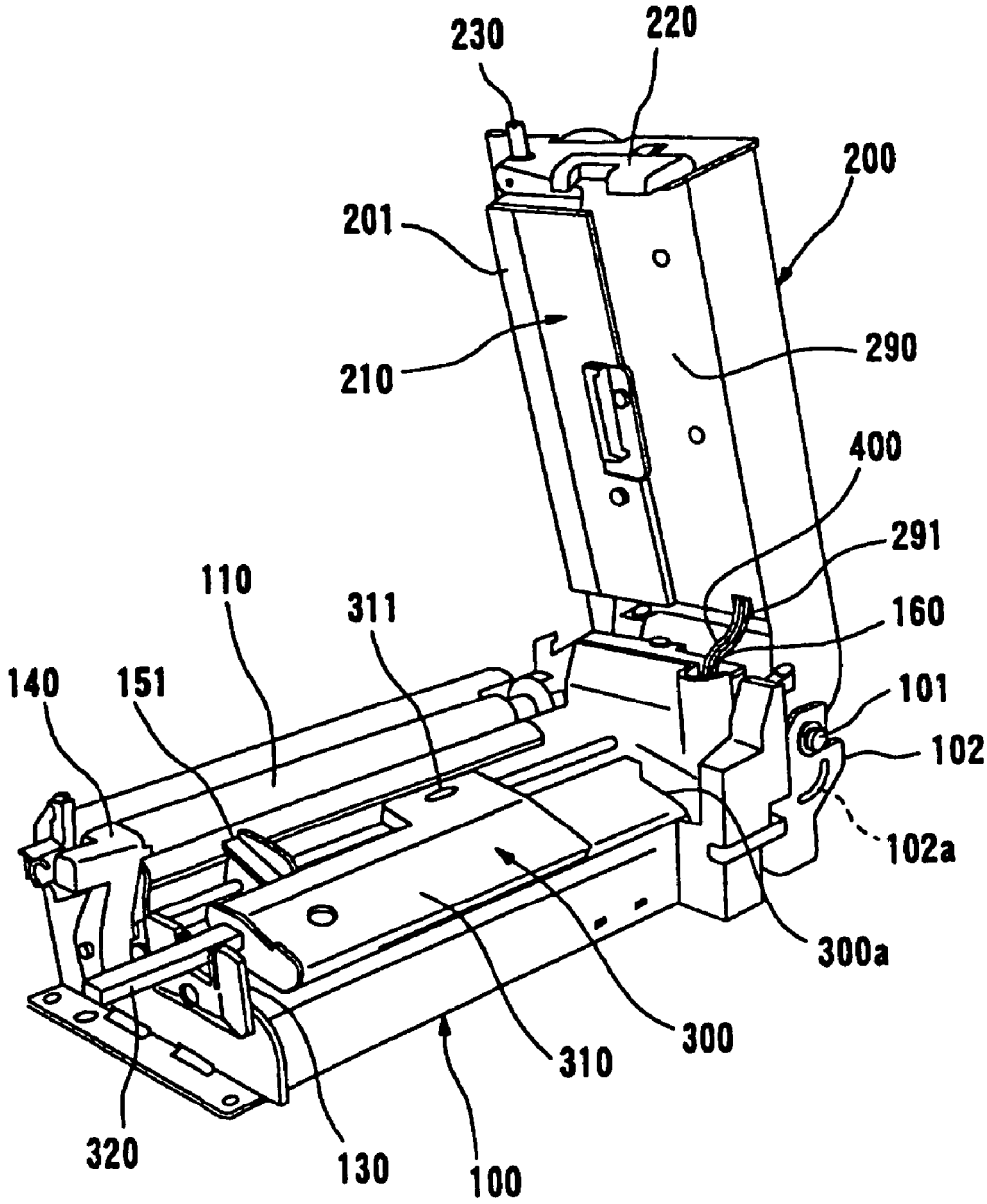

A head support plate 210 is mounted on the lower surface of the head unit 200, and the linear print head 201 is provided on the head support plate 210 (for example, see FIG. 4). The base end of the head unit 200 is mounted to one side end portion of the printer main body 100 through a supporting shaft 101, and it is freely swingable in an angular range from a close position shown in FIG. 1 to an open position shown in FIG. 3.

Here, at the close position shown in FIG. 1, the print head 201 is disposed at the print position. The print position is a position at which the print head 201 comes in contact with or in proximity to a sheet loaded in a sheet feeding orbit. On the other hand, as the open position shown in FIG. 3, the print head 201 is disposed at the evacuated position. The evacuated position is a position at which the print head 201 is spaced from a sheet loaded in the sheet feeding orbit.

The head unit 200 is urged to be opened by an urging member such as a coil spring or the like (not shown) at all times. As shown in an enlarge scale in FIGS. 8A, 8B, a braking projection 202 is provided to the base end of the head unit 200, and a braking plate 102 having a protrusion bar 102*a* extending in an arcuate shape is provided around the support shaft 101 of the printer main body 100. The protrusion bar 102*a* is designed to swell toward the sheet surface side of FIG. 8A. The braking projection 202 and the braking plate 102 constitutes braking means for braking the head unit 200 turning to the open position by the urging force of the urging member.

That is, the braking projection 202 rotates integrally with the head unit 200, and comes in sliding contact with the protrusion bar 102*a* formed on the braking plate 102 at midpoint from the close position to the open position, and then this sliding contact state is continued until the head unit 200 reaches the open position. The sliding contact of the braking projection 202 with the protrusion bar 102*a* brakes the opening operation of the head unit 200 by the urging member, and thus there can be avoided the risk that the head unit 200 moves with great force and a buts against an operator.

Next, a sensor support plate 310 is provided to the sensor unit 300, and a sheet sensor 311 is mounted on the sensor support plate 310 (see FIG. 3). The sensor support plate 310 is freely movable in the longitudinal direction of the sensor unit 300.

With respect to the sensor unit 300, the base end 300*a* thereof is mounted to the one side end portion of the printer main body 100 through a supporting shaft (not shown), and it is freely rotated din an angular range from the close position shown in FIG. 1 to the open position shown in FIG. 3. Here, the rotational center of the sensor unit 300 is set to be displaced inwardly from the rotational center of the head unit 200.

At the close position shown in FIG. 1, the sheet sensor 311 is disposed at the detection position. The detection position is a position at which the sheet sensor 311 comes into contact with or approaches to a sheet loaded in the sheet feeding orbit. On the other hand, at the open position, the sheet sensor 311 is disposed at the non-detection position. The non-detection position is a position at which the sheet sensor 311 is spaced from a sheet loaded in the sheet feeding orbit.

A rod-shaped portion 320 extends in the axial direction from the other end of the sensor unit 300. A protrusion bar 321 extending in the axial direction in a fixed-length area from the base end is provided at each of both the side edges of the rod-shaped portion 320. Different parts of the protrusion bar 321 serve as first and second catching portions 321*a*, 321*b* (see FIGS. 9A to 9C).

As shown in FIGS. 1 to 4, a first fixing member 220 is mounted at the tip of the head unit 200. Furthermore, a second fitting member 130 is mounted at the side end portion of a side of the printer main body 100 at which the tip portions of the head unit 200 and the sensor unit 300 approach to each other/separate from each other.

Figure 9C:
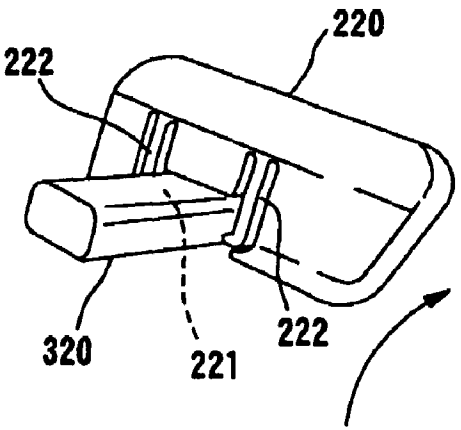
FIGS. 9A to 9C are perspective views showing the engagement/disengagement between the first, second engaging members and first, second catching portions.
Figure 9B:
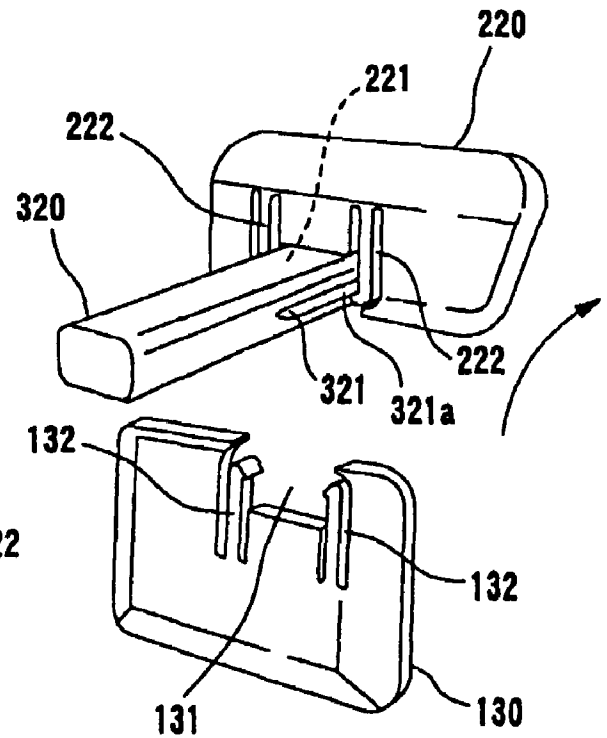
Figure 9A:
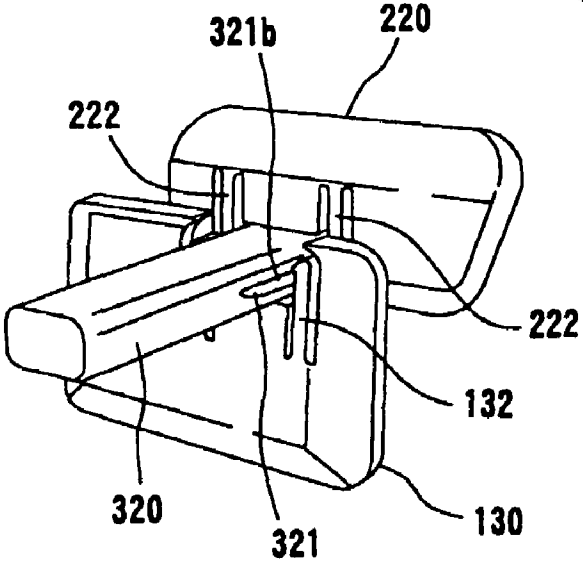

FIGS. 9A to 9C are perspective views showing the engaging/disengaging relationship between the first and second fixing members and the first and second catching portions formed on the sensor unit.

The first fixing member 220 provided to the head unit 200 is equipped with a first recess portion 221 in which the rod-shaped portion 320 provided to the sensor unit 300 is engaged, and first latch pawls 222 are formed at the inner edge of the first recess portion 221. The first latch pawls 222 are freely engaged with/disengaged from the first catching portions 321*a* of the sensor unit 300.

A second recess portion 131 in which a rod-shaped portion 320 formed in the sensor unit 300 is fitted from the upper side is provided to the second fitting member 130 provided to the main printer body 100, and second latch pawls 132 are formed in the inner edge of the second recess portion 131. The second latch pawl 132 is fitted to the second catching portion 321*b* of the sensor unit 300 to fix the sensor unit 300 when the sensor unit 300 is located at the close position (that is, the sheet sensor 311 is located at the detection position). The first and second recess portions 131 and 221 are fitted to the rod-shaped portions 320 of the sensor unit 300 from the confronting sides thereof.

Here, the latch force of the first latch pawl 222 to the first catching portion 321*a* is set to be larger than the latch force of the second latch pawl 132 to the second catching portion 321*b*.

As shown in FIG. 3, a lock member 140 is provided to the side end portion of the printer main body 100 (the side end portion at which the second fitting member 130 is mounted), and a lock pin 230 which is hooked to and detached from the lock member 140 is provided so as to project the tip portion of the head unit 200. The lock member 140 hooks the lock pin 230 to keep the head unit 200 at the close position when the head unit 200 is located at the close position (see FIG. 1).

According to the printer of this embodiment thus constructed, the head unit 200 and the sensor unit 300 can be rotated as follows.

First, when each of the units 200 and 300 is located at the close position, the first latch pawl 222 of the head unit 200 is fitted to the first catching portion 321*a* formed in the rod-shaped portion 320 of the sensor unit 300, and also the second latch pawl 132 of the printer main body 100 is fitted to the second catching portion 321*b* formed in the rod-shaped portion 320 of the sensor unit 300 as shown in the enlarged view of FIG. 9A. Accordingly, the sensor unit 300 is fixed to the printer main body 100, and the sheet sensor 311 can keep the detection position.

When the lock member 140 is manipulated to release the engagement state of the lock pin 230 from the state of FIG. 1, the head unit 200 is rotated in the opening direction by the urging force of the urging member (not shown).

When the head unit 200 is rotated in the opening direction, the latch force of the first latch pawl 222 to the first catching portion 321*a* is larger than that of the second latch pawl 132 to the second catching portion 321*b* as described above, and thus the second latch pawl 132 is separated from the second catching portion 321*b* (see FIG. 9B). At this time, the first latch pawl 222 is kept to be fixed to the first catching portion 321*a*. Accordingly, the sensor unit 300 is rotated in the opening direction interlockingly with the rotational operation of the head unit 200 (see FIG. 2).

As described above, the sensor unit 300 can be rotated interlockingly with the rotational operation of the head unit 200, so that the work of exchanging sheets, etc. can be easily performed and also excellent operability and maintenance performance can be implemented.

When the head unit 200 is further rotated, the first recess portion 221 of the head unit 200 is moved in the axial direction relatively to the rod-shaped portion 320 of the sensor unit 300 because the rotational center of the sensor unit 300 is displaced inwardly from the rotational center of the head unit 200 as described above. When the head unit 200 is rotated by a predetermined angle, the first latch pawl 222 is naturally separated from the first catching portion 321*a* (see FIG. 9C). Accordingly, the integrity of the sensor unit 300 and the head unit 200 is released (see FIG. 3).

Figure 8B:
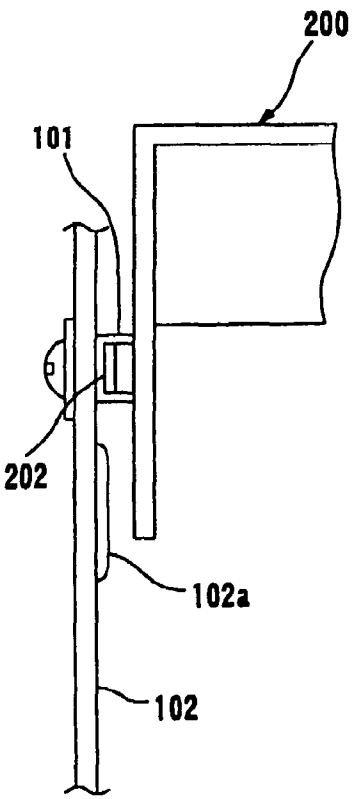
FIG. 8B is a side view showing the braking means.
Figure 8A:
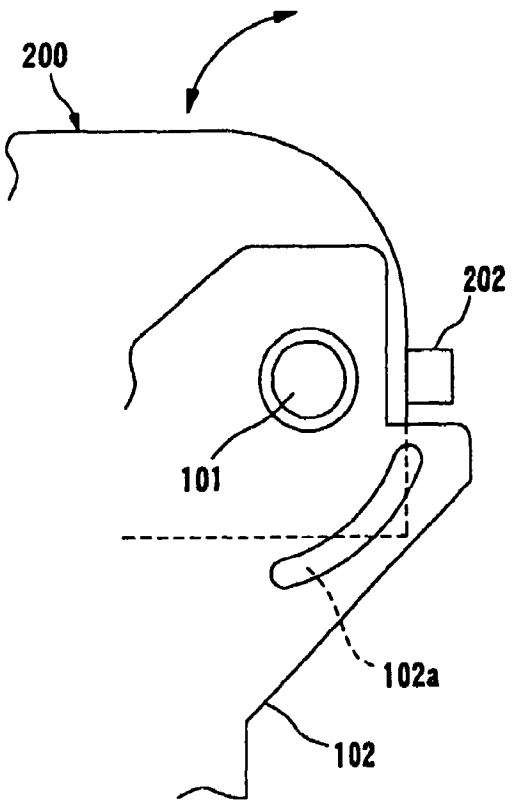
FIG. 8A is a front view showing braking means comprising a braking projection and a braking plate.

The head unit 200 is braked and stopped by the sliding contact of the braking projection 202 shown in FIGS. 8A and 8B with the protrusion bar 102*a*, and subsequently the head unit 200 is manually rotated to the rotation end and stopped at the opening position.

A guide bar 150 is disposed in the width direction on the upper surface of the printer main body 100 and below the sheet feeding orbit (see FIG. 3). A sheet guide 151 for defining the width of sheets and a sheet sensor 152 are freely movably mounted on the guide bar 150. When the sheet size is changed, the sheet guide 151 is moved in conformity with the width of sheets to be newly loaded, and also the position of the sheet sensor 152 is moved and adjusted. For example, when a detection hole indicating the attach position of a label is formed at the center portion of the sheet (label sheet) to newly loaded, the sheet sensor 152 is moved and adjusted in conformity with the position over which the detection hole passes.

At this time, the sheet sensor 311 mounted in the head unit 200 is also required to be moved and adjusted to the position so as to confront the sheet sensor 152 at the printer main body 100 side.

In the printer of this embodiment, the sensor unit 300 located at the open position is separated from the head unit 200, and freely rotatable independently. Therefore, when sheets are exchanged, only the sensor unit 300 can be rotated to the close position (see FIG. 4). At the close position, the second catching portion 321*b* is fitted to the second latch pawl 132, whereby the sheet can be pressed. Therefore, even a sheet having a tendency of curl or the like can be easily and properly disposed in the sheet feeding passage. Then, the sheet sensor 311 can be moved and adjusted by manual operation so as to confront the sheet sensor 152 at the printer main body 100 side.

When the head unit 200 located at the open position is rotated to the close position, the first latch pawl 222 is fitted to the first catching portion 321*a*, and the sensor unit 300 and the head unit 200 are connected to each other again (see FIG. 1).

Next, the structure of the head support plate will be described.

FIGS. 10A to 10D show the construction of the head support plate.

The head support plate 210 is formed of plate material of aluminum alloy, and a linear print head 201 is mounted in the width direction along the tip edge 210*a* of the front side. Furthermore, a connector 212 for wires is provided in a cutout portion 211 formed at the center portion, and electrically connected to the print head 201. The whole upper surface of the head support plate 210 is covered by an insulating sheet 213 except for the thermal sensitive portion of the print head 201.

Figure 10C:
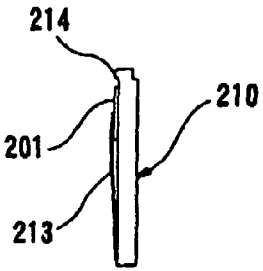
FIG. 10C is a side view of the head support plate.
Figure 10D:
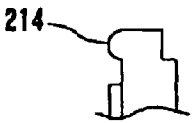
FIG. 10D is an enlarged side view showing a projection formed at the tip edge of the head support plate.
Figure 10A:
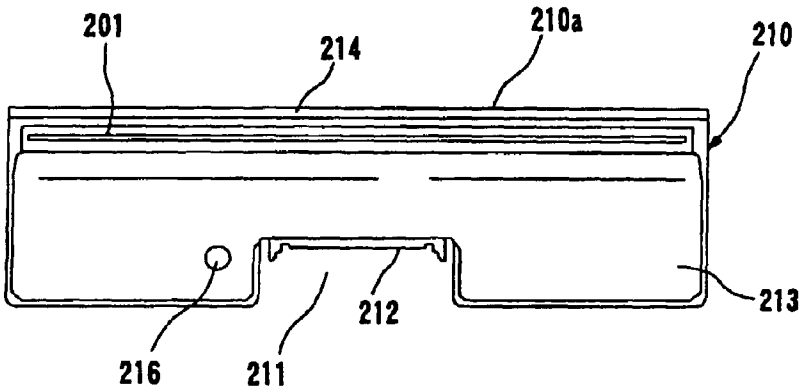
FIG. 10A is a front view showing a head support plate.
Figure 10B:
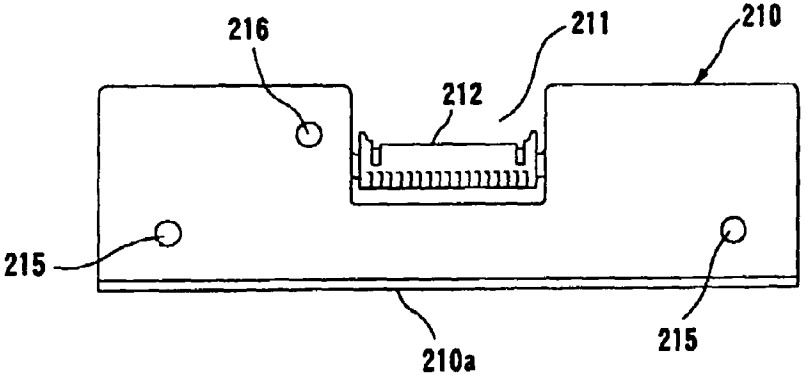
FIG. 10B is a back view of the head support plate.

Here, as shown in the enlarge view of FIG. 10D, a protrusion bar 214 having a semispherical section is formed along the print head 201. In the case of the label printer, there is a case where a label sheet loaded in the sheet feeding orbit is moved in the opposite direction to the sheet discharge direction (returning operation) to adjust the print position or the like. At this time, there is a risk that the edge of the label is hooked to the edge of the print head 201 and thus exfoliated from a mat board. Therefore, in this embodiment, the protrusion bar 214 having the semispherical section is formed at the tip edge 210*a* of the head support plate 210 along the print head 201, and the edge of the label carrying out the returning operation is lifted up by the protrusion bar 2144, thereby avoiding the trouble that the edge of the label comes into contact with the edge of the print head 201.

The protrusion bar 214 can be simply formed by halfway pressing the tip edge 210*a* portion of the head support plate 210 formed of an aluminum alloy plate from the back side.

Figure 11:
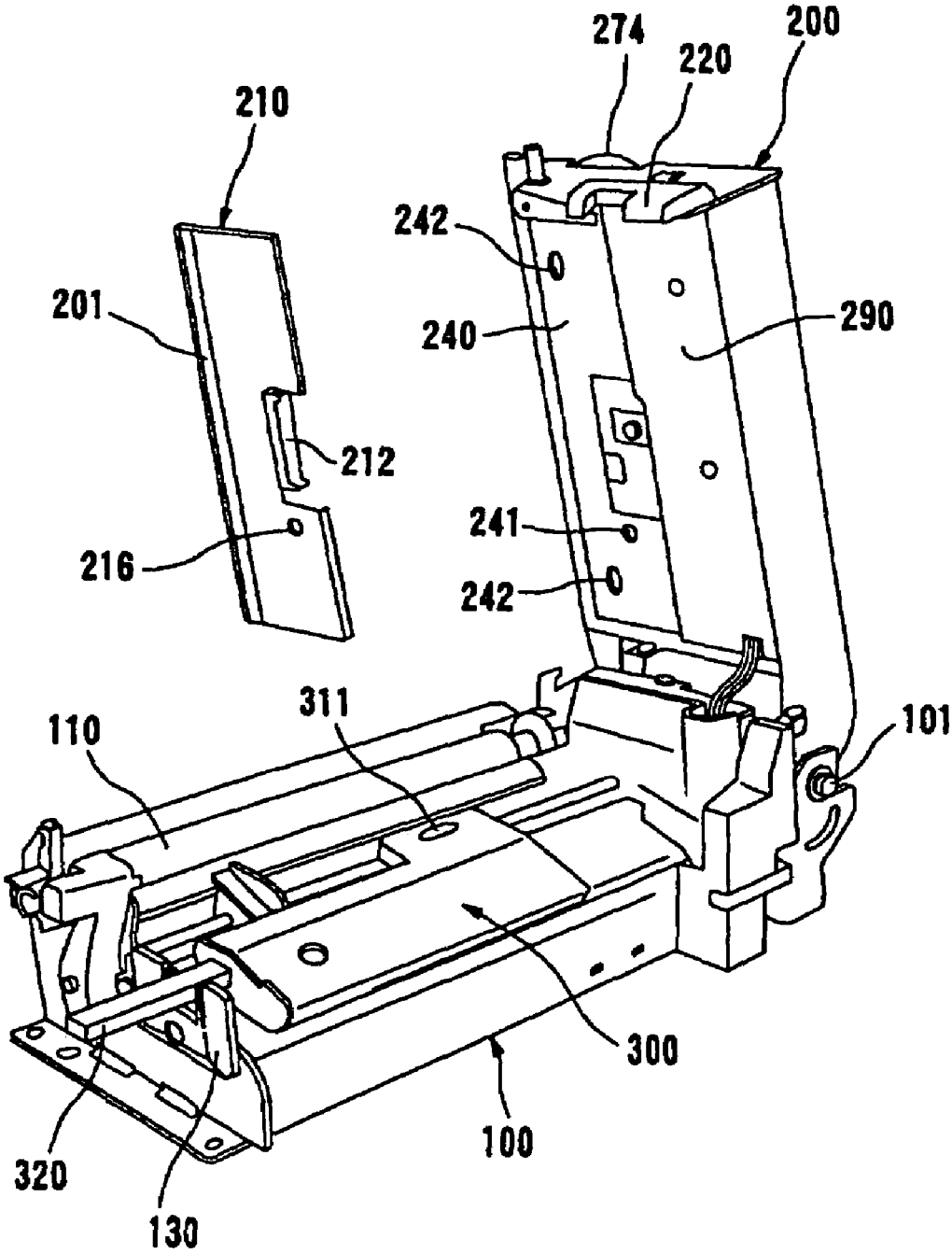
FIG. 11 is a perspective view showing a mounting structure of the head support plate.

Positioning projections 215, 215 are formed at the back surface of the head support plate 210 thus constructed, and a fastening hole 216 such as a screw hole or the like is formed at a part of the head support plate 210. Furthermore, as shown in FIG. 11, the head unit 200 contains a head support member 240 therein. A fastening hole 241 such as a screw hole or the like is provided at the position corresponding to the fastening hole 216 of the head support plate 210 on the surface of the head support member 240. Furthermore, elongated holes 242, 242 are formed at the positions corresponding to the positioning projections 215, 215 of the head support plate 210 in the head support member 240.

The head support plate 210 can be mounted on the surface of the head support plate 210 by disposing the positioning projections 215, 215 in conformity with the elongated holes 242, 242 of the head support member 240 and fitting the fastening tools such as screws or the like into the fastening holes 216, 241 from the front surface side. This work can be easily performed from the lower surface side of the head unit 200.

As shown in FIG. 12A, a front-and-rear tilt adjusting mechanism 250 for the head support plate 210 is provided at the inner bottom portion of the head unit 200.

As shown in the enlarged view of FIG. 12B, the head support member 240 mounted on the surface of the head support plate 210 is mounted to the head unit 200 by fitting the mount holes 240*a*, 240*a* formed at two places of the front end edge portion to key-shaped support portions 203, 203 provided to the side wall of the head unit 200. In this mount structure, the head support member 240 is freely rotatable and suitably freely movable in the vertical direction.

The lock pin 230 described above extends from one side surface of the head member 24, and a pin having the same shape extends from the symmetrical position of the other side surface. These pins are fitted to both the side walls of the head unit 200 and constitutes the rotation fulcrum of the head support member.

A fitting piece 243 extending from the center portion of the rear end edge is moved and adjusted in the vertical direction by the front-and-rear tilt adjusting mechanism 250, whereby the head support plate 210 mounted on the head support member 240 is rotated around the support portions 203, 203 of the front end edge, and kept under a horizontal attitude or any inclined attitude. The contact position of the print head 201 with the sheet is minutely varied in the front-and-rear direction by the front-and-rear tilt adjustment. The proper print operation can be implemented by properly executing this adjustment in conformity with the rigidity of the sheet. For example, in the case of a thin sheet having small rigidity, the optimum print point is located substantially immediately above the center of the platen 110, and in the case of a thick sheet having large rigidity, the optimum print point is located to be nearer to the sheet discharge side than the center of the platen 110.

That is, the front-and-rear tilt adjusting mechanism 250 constitutes a contact position adjusting portion of the print head 201 with the sheet.

Figure 13A:
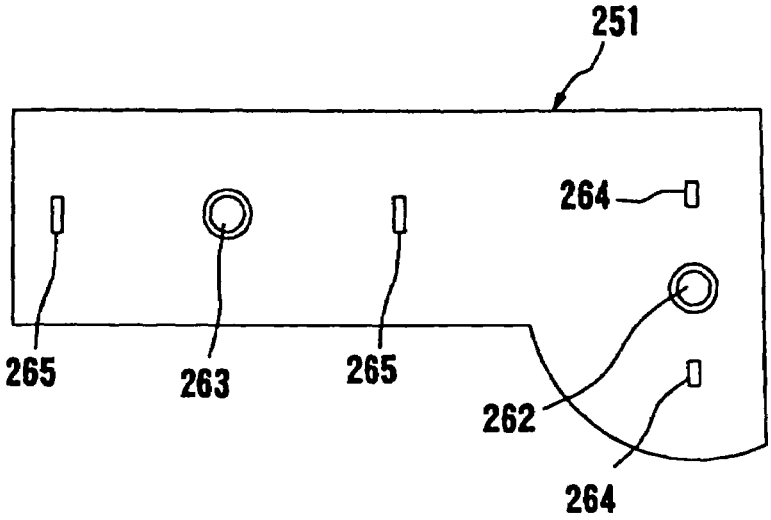
FIG. 13A is a front view showing a support member constituting a front-and-rear tilt adjusting mechanism.
Figure 13B:
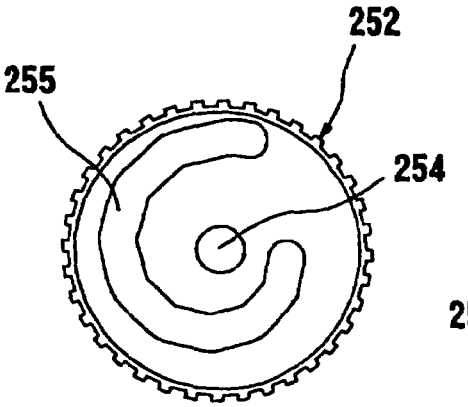
FIG. 13B is a front view showing an operating member constituting the front-and-rear tilt adjusting mechanism.
Figure 13C:
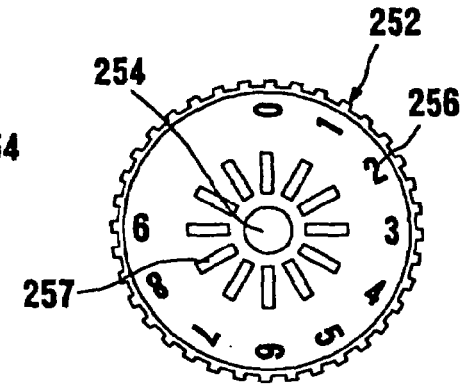
FIG. 13C is a back view showing the operating member.
Figure 13D:
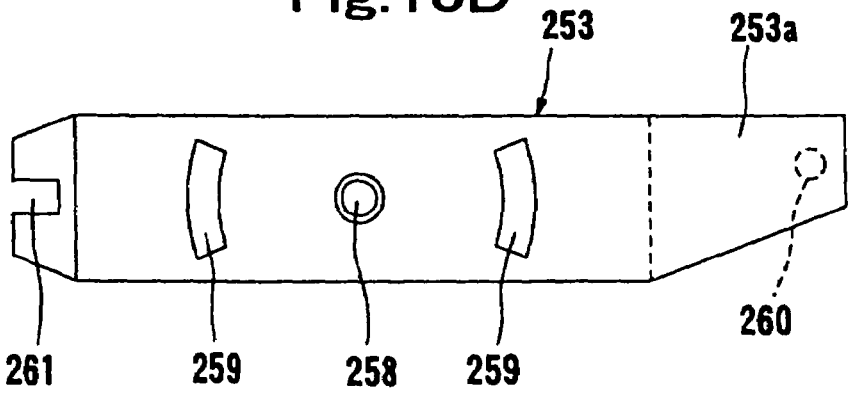
FIG. 13D is a front view showing a cam follower constituting the front-and-rear tilt adjusting mechanism.

The front-and-rear tilt adjusting mechanism 250 comprises a supporting member 251 shown in FIG. 13A, an operating member 252 shown in FIGS. 13B, 13C and a cam follower 253 shown in FIG. 13D. FIG. 13B shows one end surface of the operating member 252, and FIG. 13C shows the other surface of the operating member 252.

The operating member 252 is designed in a disc-shape and has a mount hole 254 at the center thereof. Furthermore, as shown in FIG. 13B, a cam 255 comprising a peripheral groove is formed on one end surface of the operating member 252 so that the distance thereof from the center varies stepwise. Furthermore, calibrations for indicating the operation position of the operating member 252 are incised in the peripheral direction on one end surface of the operating member 252. Furthermore, plural recess portions 257 are formed to be spaced from one another in the peripheral direction on the other end surface of the operating member 252 as shown in FIG. 13C.

As shown in FIG. 13D, a mount hole 258 is formed substantially at the center position of the cam follower 253, and cut-out holes 259, 259 having an arcuate shape are formed at two positions around the mount hole 258. The tip portion 253*a* of the cam follower 253 is designed so as to be thin-walled and elastically bent, and a projection 260 fitted in the cam 255 is formed at the tip of the tip portion 253*a*. A cut-out groove 261 which is fitted to the fitting piece 243 of the head support member 240 is formed at the base end of the cam follower 253.

As shown in FIG. 13A, two support shafts 262, 263 are formed on the front surface of the support member 251 so as to project from the front surface, and projecting portions 264 is formed around the support shaft 262.

Figure 14:
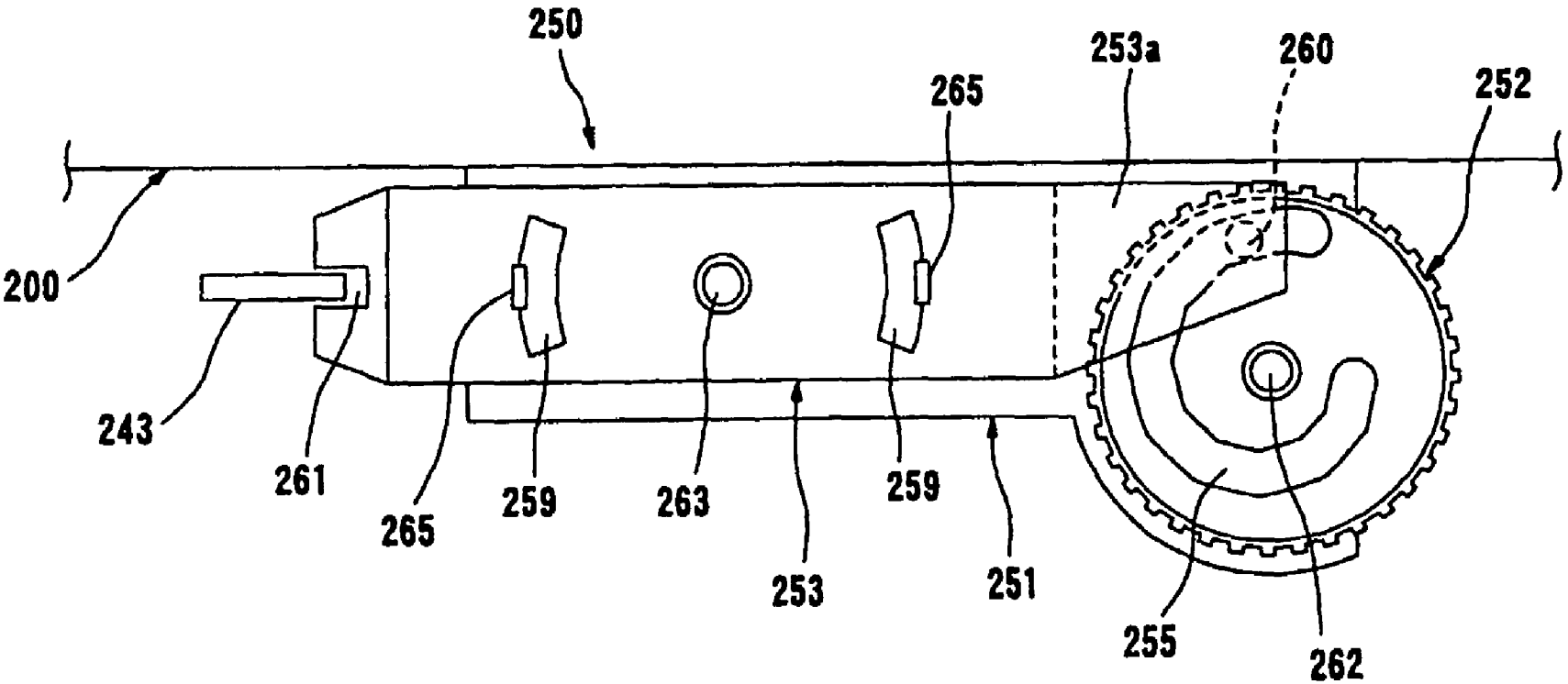
FIG. 14 is a front view showing the front-and-rear tilt adjusting mechanism.

As shown in FIG. 14, the operating member 252 is freely rotatably mounted on the support shaft 263 while the mount hole 254 is engaged with the support shaft 263. Here, the operating member 252 is mounted on the support member 251 so that one surface thereof on which the cam 255 is formed serves as a front surface side and the other surface thereof on which the recess portion 257 is formed serves as a back surface side (that is, the surface side coming into contact with the front surface of the support member 251). At this time, the recess portion 257 of the operating member 252 is disposed at such a position as to be freely engaged with/disengaged from the recess portion 264 formed on the support member 251.

Furthermore, the cam follower 253 is freely swingably mounted on the other support shaft 263 formed on the front surface of the support member 251 so that the mount hole 258 is fitted to the support shaft 263. At this time, the projection 260 formed at one end of the cam follower 253 is fitted in the cam 255 comprising the peripheral groove. The tip portion 253*a* of the cam follower 253 comes into contact with the surface of the operating member 252 (the cam 255 formed surface) and elastically keeps the surface of the operating member 252 (see FIG. 14). As a result, the tip portion 253*a* presses the operating member 252 to bring click sense to the operating member 252.

Hook portions 265, 265 are projectingly formed at the positions corresponding to the cut-out holes 259, 259 of the cam follower 253 on the front surface of the support member 251, and the peripheral edge portions of the cut-out holes 259, 259 formed in the cam follower 253 are fitted to the hook portions 256, 265, whereby the cam follower 253 can be prevented from dropping off from the cam follower 253. The dimension in the vertical direction of cut-out holes 259, 259 is set so that the cam follower 253 is allowed to be swung.

The fitting piece 243 of the head support member 240 is fitted in the cut-out groove 261 formed at the other end of the cam follower.

The front-and-rear tilt adjusting mechanism 250 achieved by assembling the respective parts as described above can be mounted at the inner bottom portion of the head unit 200, and thus the mounting work can be easily performed.

Figure 17A:
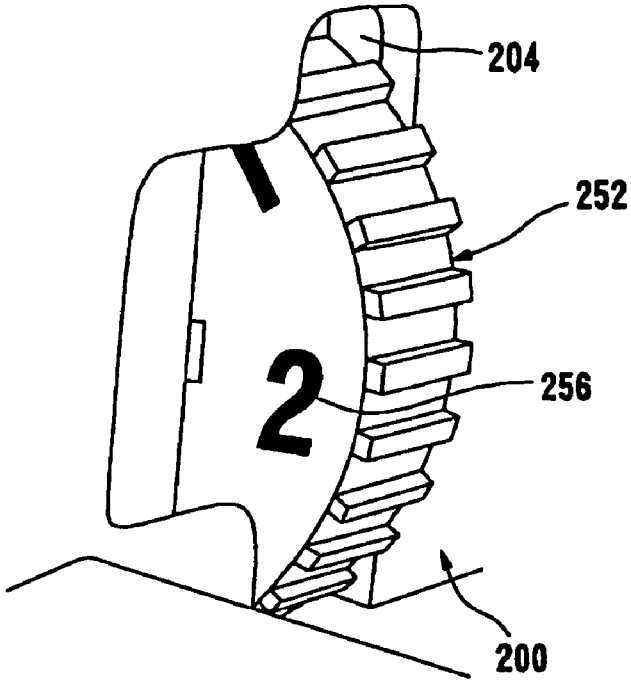
FIG. 17A is a perspective view showing a cut-out window through which the operating member of the front-and-rear tilt adjusting mechanism is partially exposed.

As shown in FIG. 17A, a cut-out window 204 is formed at a predetermined position on the side wall of the head unit 200, and a part of the operating member 252 is exposed from the cut-out window 204 so that the calibration 256 incised at the portion exposed from the cut-out window 204 can be viewed from the outside. An operator rotates the operating member 252 by using the calibration 256 as an indication, whereby the tilt in the front-and-rear direction of the head support plate 210 can be adjusted.

The front-and-rear tilt adjusting mechanism 250 mounted in the head unit operates as follows. That is, when the operating member 252 is rotated, the projection 260 is moved in the vertical direction along the cam 255, and also the cam follower 253 is swung around the support shaft 263. The head support member 240 whose fitting piece 243 is fitted in the cut-out groove 261 of the cam follower 253 is rotated around the lock pin 230 interlockingly with the cam follower 253. Here, the cam follower 253 and the cam 255 function as an adjusting mechanism for adjusting the contact position of the print head 201 with a sheet inserted between the platen 110 and the print head 201.

The tilt in the front-and-rear direction of the head support plate 210 is adjusted by the front-and-rear adjusting mechanism 250, so that the print head can be adjusted to the optimum print point of the contact position.

Furthermore, at a discontinuous operating position of the operating member 252, any recess portion 257 formed in the operating member 252 is engaged with the projecting portion 264 of the support member 251 with click sense. Accordingly, the operating position is kept, and the unintentional rotation of the operating member 252 can be prevented. That is, the recess portion 257 and the projecting portion 264 constitute operating position keeping means for keeping the operating member 252 at the discontinuous operating position with click sense.

In addition, the support member 251 can be rotated with click sense, so that the operation of setting the calibration 256 can be easily performed and the adjustment can be performed with fixed reproducibility even when the operator is changed.

Next, a pressure center point moving mechanism 270 for the print head 201 is provided to the inner bottom portion of the head unit 200 as shown in FIG. 12A.

As described above, the front end edge portion of the head support member 240 mounted on the support portions 203, 203 of the head unit 200 is allowed to be moved in the vertical direction in a fixed range (see FIG. 12B). The head support member 240 is pressed and urged downwardly from two places at the back side by urging members 271, 272 such as coil springs or the like, and it is kept under a fixed attitude by this urging force.

Here, the urging member 271 is held at the inner bottom portion of the head unit 200, and the other urging member 272 is supported by a cam follower 273 of the pressure center point moving mechanism 270.

Figure 15A:
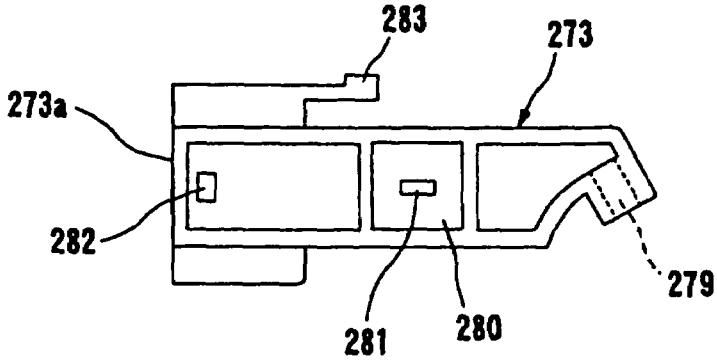
FIG. 15A is a bottom view showing a cam follower constituting the pressure center point moving mechanism.
Figure 15B:
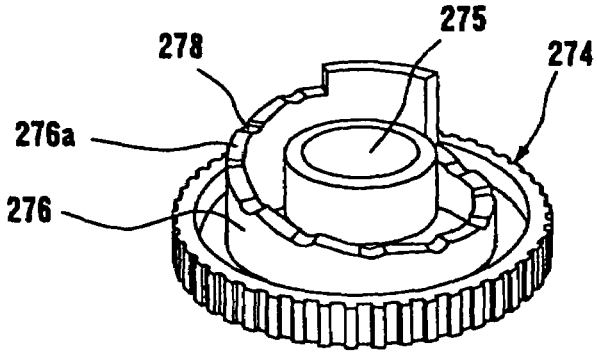
FIG. 15B is a perspective view showing the operating member constituting the pressure center point moving mechanism.
Figure 15C:
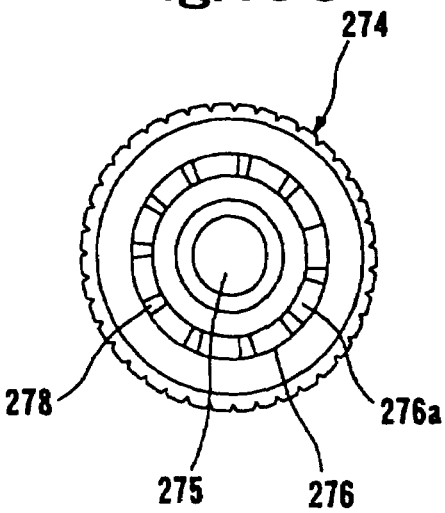
FIG. 15C is a front view showing the operating member.
Figure 15D:
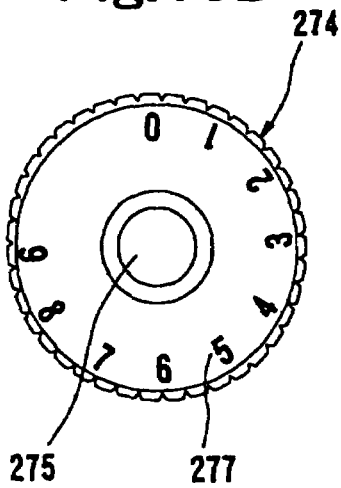
FIG. 15D is a back view showing the operating member.

The pressure center point moving mechanism 270 comprises a cam follower 273 shown in FIG. 15A, and an operating member 274 shown in FIGS. 15B, 15C and 15*d*. FIG. 15C shows one end surface of the operating member 274, and FIG. 15D shows the other end surface of the operating member 274.

Figure 16:
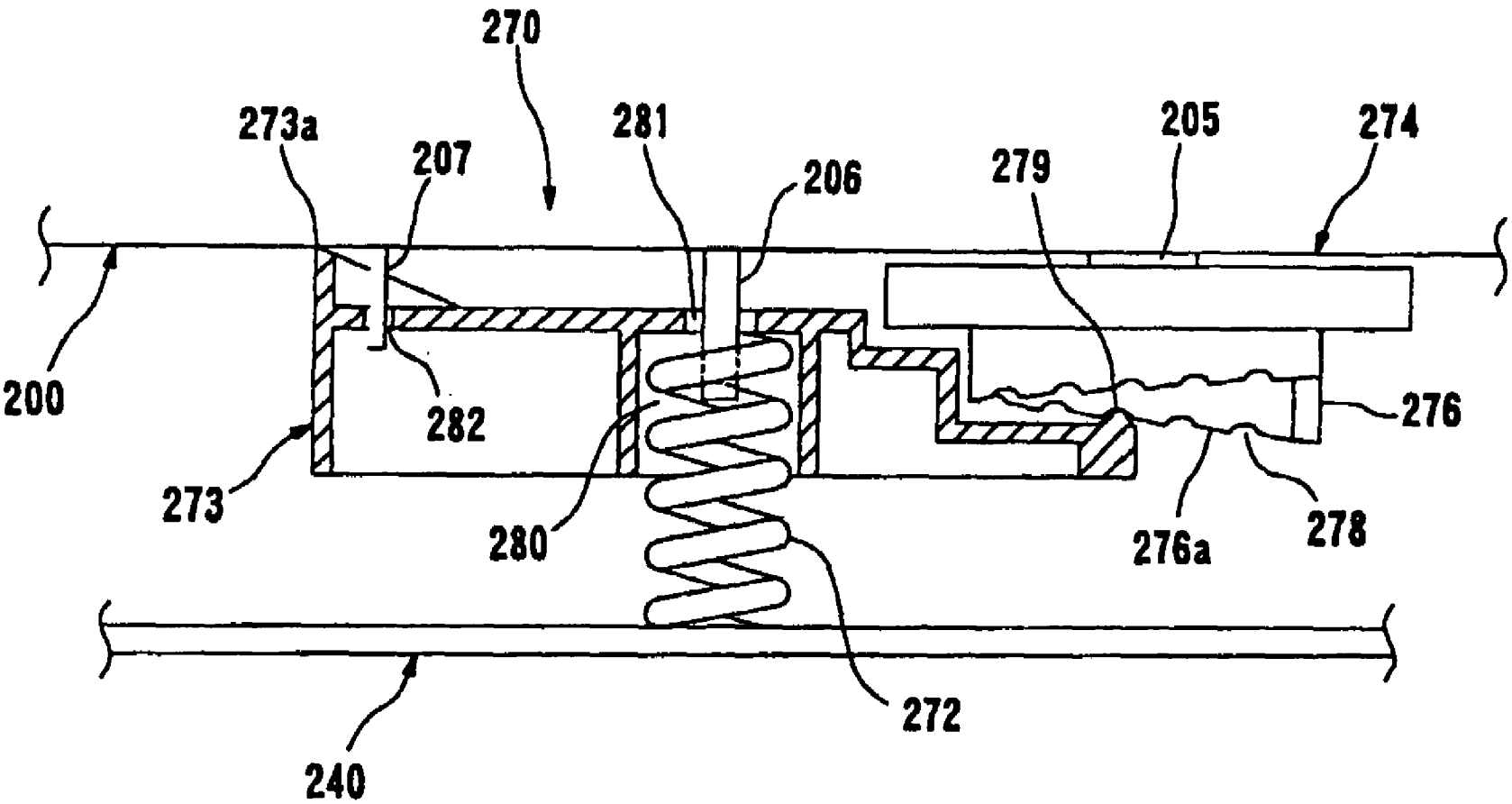
FIG. 16 is a partially cross-sectional front view showing the pressure center point moving mechanism.

The operating member 274 is designed in a disc-shape, and has a mount hole 275 at the center thereof. As shown in FIG. 16, the operating member 274 is freely rotatably mounted on a support shaft 205 which is projectingly provided to the inner bottom surface of the head unit 200.

A cylindrical portion forming a cam 276 is projectingly provided to one end surface of the operating member 274 (see FIGS. 15B, 16). The tip surface of the cylindrical portion is a spiral slant surface. The slant surface constitutes a cam face 276*a*. Furthermore, calibrations 277 indicating the operating position are incised on the other end surface of the operating member 274 (see FIG. 15D).

As shown in FIGS. 15B and 16, recess portions 278 are formed at discontinuous positions on the cam face 276*a*, and at a discontinuous operating position of the operating member 274, a projecting portion 279 of the cam follower 273 is engaged with the recess portion 278 with click sense. Accordingly, the operating position concerned is kept, and unintentional rotation of the operating member 274 is prevented. That is, the recess portion 278 and the projecting portion 279 constitute operating position holding means for holding the operating member 274 at a discontinuous position with click sense.

In addition, the support member 274 can be rotated with click sense, so that the operating of setting the calibration 277 can be easily performed, and the adjustment can be performed with fixed reproducibility even when the operator is changed.

The cam follower 273 is provided with a projecting portion 279 at the tip portion thereof, and the projecting portion 279 is fitted to the cam face 276*a* of the operating member 274 as described above. In the cam follower 273, the base end corner portion 273*a* abuts against the inner bottom portion of the head unit 200 and constitutes a swing fulcrum.

A recess portion 280 for supporting the urging member 272 is formed at the center portion of the cam follower 273, and a cut-out hole 281 is formed at the inner bottom portion. Furthermore, a support pin 206 is projectingly provided in connection with the cut-out hole 281 at the inner bottom portion of the head unit 200, and when the cam follower 273 is mounted at the inner bottom portion of the head unit 200, the support pin 206 penetrates through the cut-out hole 281 and is disposed in the recess portion 280. One end of the urging member 272 is disposed in the recess portion 280 of the cam follower 273 while supported by the support pin 206. The other end of the urging member 272 abuts against the head support member 240.

The cam follower 273 is provided with a cut-out hole 282 in the neighborhood of the base end, and when the cam follower 273 is mounted at the inner bottom portion of the head unit 200, a positioning pin 207 which is projectingly provided to the inner bottom portion of the head unit 200 is fitted in the cut-out hole 282. The positioning pin 207 keeps the cam follower 273 at a fixed position of the head unit 200.

As shown in enlarged view of FIG. 12C, a holding pin 208 is projectingly provided to the inner wall of the head unit 200, and an abutting portion 283 is formed so as to extend from one side surface of the cam follower 273 and confront the holding pin 208. The abutting portion 283 and the holding pin 208 constitute drop-off preventing means of the cam follower 273, and when the cam follower 273 is about to drop off from the positioning pin 207, the abutting portion 283 abuts against the holding pin 208 to prevent drop-off of the cam follower 273.

That is, under the mount state shown in FIG. 16, the cam follower 273 is kept to be pressed to the inner bottom portion side of the head unit 200 by the urging member 272. However, there is a risk that the holding state concerned is released and the cam follower 273 drops off when the cam follower 273 is mounted in the head unit 200 or when the head support member 240 is detached from the head unit 200 for maintenance. The unintentional drop-off described above can be prevented by making the abutting portion 283 abut against the holding pin 208, and excellent workability can be secured.

Figure 17B:
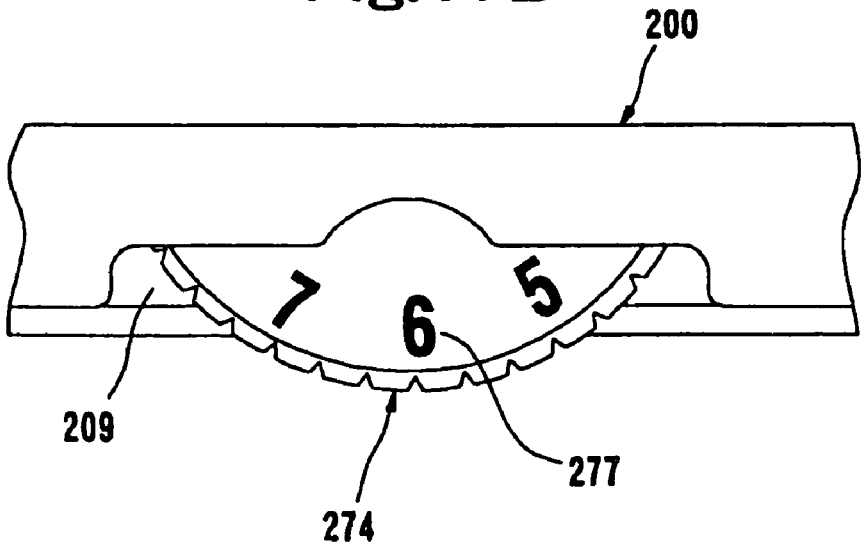
FIG. 17B is a plan view showing a cut-out window through which the operating member of the pressure center point moving mechanism is partially exposed.

As shown in FIG. 17B, a cut-out window 209 is formed at a predetermined position of the head unit 200, and a part of the operating member 274 is exposed from the cut-out window 209. A calibration 277 incised at the portion exposed from the cut-out window 209 can be viewed from the outside. The operator can rotate the operating member 274 by using the calibration 277 as an indication, and adjust the urging force of the urging member 272.

The pressure center point moving mechanism 270 mounted in the head unit 200 operates as follows. That is, when the operating member 274 is rotated, the projecting portion 279 of the cam follower 273 is moved in the vertical direction along the cam face 276*a*, and also the cam follower 273 swings around the swing fulcrum of the base end corner portion 273*a*. In connection with this operation, the compression state of the urging member 272 disposed between the cam follower 273 and the head support member 240 varies, and the urging force acting on the head support member 240 varies.

It is preferable that the print head 201 is in contact with the sheet under uniform pressure. Accordingly, the pressure center point of the print head 201 must be located at the center of the sheet. Therefore, by adjusting the urging force of the urging member 272, the pressure center of the print head 201 is moved to the vicinity of the center portion of the sheet so that the print head 201 comes into contact with the sheet under uniform pressure.

As described above, the cam 276, the cam follower 273 and the urging member 272 constitute a mechanism for adjusting the contact pressure acting state of the print head 201 to the sheet, and the pressure center point moving mechanism 270 constitutes a contact pressure acting state adjusting portion.

The front-and-rear tilt adjusting mechanism 250 and the pressure center point moving mechanism 270 described above are disposed to get together at one side surface of the inner bottom portion of the head unit 200. In addition, the operating members 252 and 274 are exposed from one side surface of the head unit 200, and thus they can be operated at the side surface concerned. Therefore, the operability is excellent, and the adjusting work can be simply performed.

Returning to FIG. 4, a cable guide 290 is mounted in alignment with the head support member 240, and a cut-out hole 291 is formed at the end portion of the bottom surface side of the cable guide 290. A cable guide hole 160 is provided to the printer main body 100 so as to confront the cut-out hole 291 when the head unit 200 is located at the close position. The cable guide hole 160 is provided at the inner side from the rotating shaft of the head unit 200. Accordingly, the electrical cable 400 is prevented from protruding to the outside of the printer main body 100, and the apparatus can be miniaturized.

The electrical cable 400 connected to the print head 201 passes from the cable guide 290 through the cut-out hole 291 to the cable guide hole 160, and then it is connected to a circuit board in the printer main body 100.

The present invention is not limited to the above-described embodiment, and it is needless to say that various modifications or applications may be implemented.

Figure 18:
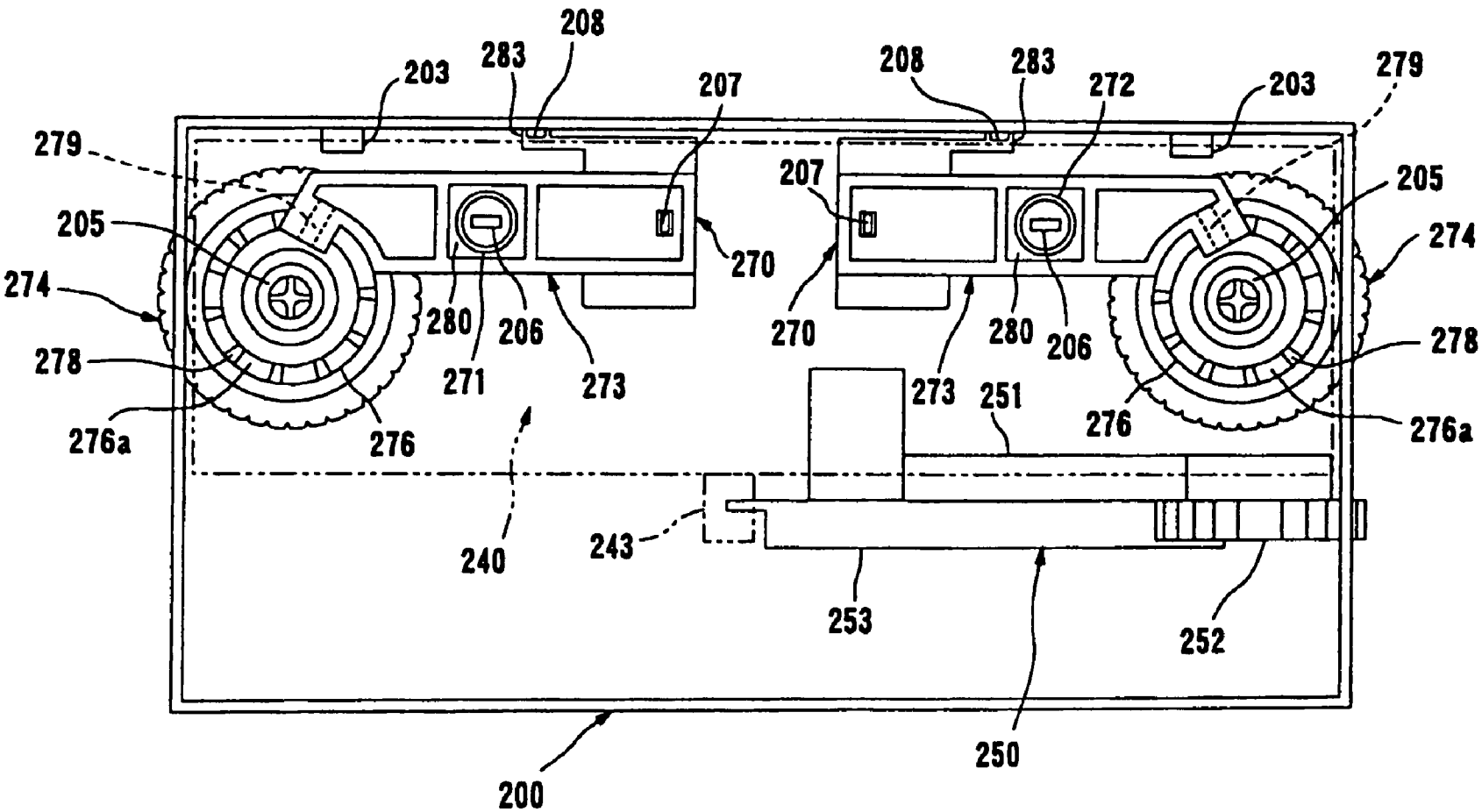
FIG. 18 is a bottom view showing an applied example of the pressure center point moving mechanism.

For example, if the apparatus is designed so that a pair of pressure center point moving mechanisms 270 serving as the adjusting mechanism for adjusting the contact pressure acting state of the print head 201 are provided at the symmetrical positions in the width direction with the center of the head unit 200 as the boundary, and the pressure center point moving mechanisms 277, 277 are used to support the respective urging members 271, 272 as shown in FIG. 18, the pressure center point adjustment of the print head 201 to the sheet and the contact pressure adjustment of the print head 201 to the sheet can be performed by operating the respective mechanisms 277, 277. In this case, the pressure center point moving mechanisms 277, 277 function as a pressure center point moving-contact pressure adjusting mechanism.

Figure 19:
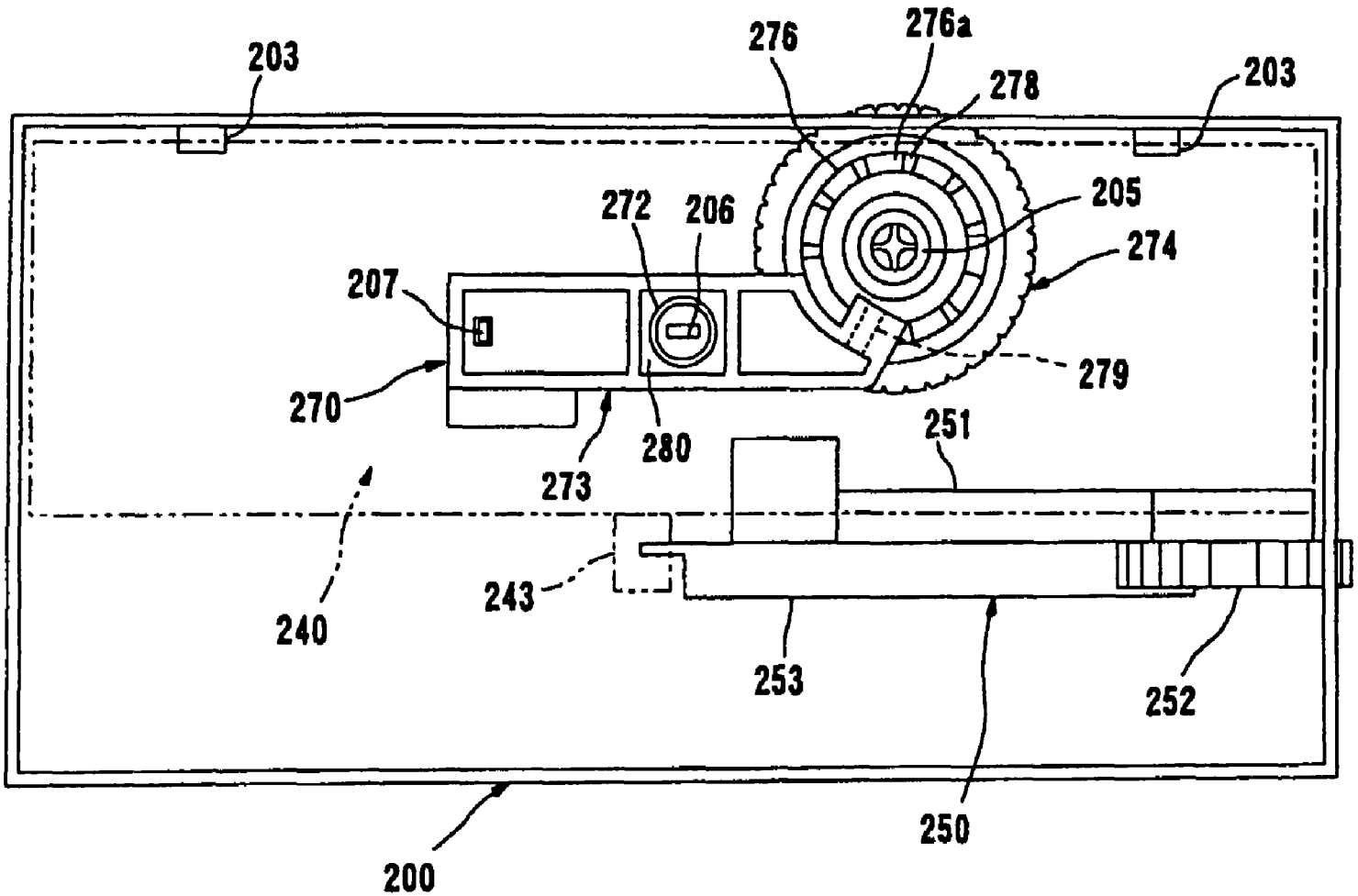
FIG. 19 is a bottom view showing an applied example in which the pressure center point moving mechanism is made to function as a contact pressure adjusting mechanism.

Furthermore, as shown in FIG. 19, if the urging member 272 is disposed at the center portion in the width direction of the head unit 200 and the urging member 272 is supported by the same mechanism as the pressure center point moving mechanism 277, the contact pressure adjustment of the print head 201 to the sheet can be performed by operating the mechanism 277. In this case, the mechanism 277 function as the contact pressure adjusting mechanism.

INDUSTRIAL APPLICABILITY

As described above, according to the present invention, the contact pressure acting state or contact position of the print head to the sheet inserted into the gap between the platen and the print head can be adjusted, and also the state thus adjusted can be surely kept. Therefore, a high-precision print operation can be stably executed over a long term.

The invention claimed is:

1. A printer having a printer main body, a print head for executing a print operation on a sheet loaded in the printer main body, and a sheet sensor for executing a predetermined detecting operation on the sheet, wherein the print head is movable between a print position at which the print head is in contact with or in proximity to the sheet and an evacuated position at which the print head is spaced from the sheet;

the sheet sensor is movable between a detection position at which the sheet sensor is in contact with or in proximity to the sheet and a non-detection position at which the sheet sensor is spaced from the sheet; and the sheet sensor is moved from the detection position to the non-detection position interlockingly with a moving operation of the print head from the print position to the evacuated position, and movable from the non-detection position to the detection position independently of the print head.

2. The printer according to claim 1, further comprising a head unit having a print head mounted therein, and a sensor unit having a sheet sensor mounted therein, a sheet being sandwiched between the sensor unit and a printer main body when the sheet sensor is disposed at a detection position, wherein first engaging means is provided so as to be freely engageable and disengageable between the head unit and the sensor unit, and the sheet sensor is moved from a detection position to a non-detection position interlockingly with a moving operation of the print head from a print position to an evacuated position under the state that the head unit and the sensor unit are engaged with each other by the first engaging means.

3. The printer according to claim 2, further comprising second engaging means that is provided so as to be freely engageable and disengageable between the printer main body and the sensor unit, wherein under the state that the print head is disposed at the print position and the sheet sensor is disposed at the detection position, the head unit and the sensor unit are engaged with each other by the first engaging means and the sensor unit and the printer main body are engaged with each other by the second engaging means, and when the print head is moved from the print position to the evacuated position from the state that each of the first and second engaging means carries out the engagement, the engagement state between the sensor unit and the printer main body by the second engaging means is released.

4. The printer according to claim 3, wherein when the print head is moved from the print position to the evacuated position and the engagement state between the sensor unit and the printer main body by the second engaging means is released, the sensor unit is movable from the detection position independently of the head, and is engageable with the printer main body by the second engaging means.

5. The printer according to claim 3, wherein the first engaging means contains a first latch pawl provided to the head unit, and a first catching portion provided to the sensor unit, the first latch pawl being freely engaged with and disengaged from the first catching portion; the second engaging means may contain a second latch pawl provided to the printer main body and a second catching portion provided to the sensor unit; the second latch pawl being freely engaged with and disengaged from the second catching portion; and the latching force of the first latch pawl to the first catching portion may be set to a value larger than the lathing force of the second latch pawl to the second catching portion.

6. The printer according to claim 5, wherein the head unit is designed so that one end thereof is freely rotatably mounted at one side portion of the printer main body, the first latch pawl is provided to the other end of the head unit, the sensor unit is designed so that one end thereof is freely rotatably mounted at one side portion of the printer main body, and the first and second catching portions are provided to the other end of the sensor unit, and the second latch pawl is provided to the other side portion of the print main body.

7. The printer according to claim 6, wherein a rod-shaped portion is provided to the other end of the sensor unit so as to extend in the axial direction, the first and second catching portions are provided at different positions of the rod-shaped portion, a first recess portion engaged with the rod-shaped portion is provided at the other end of the head unit, a first latch pawl is provided at the inner edge of the first recess portion, a second recess portion with which the rod-shaped portion of the sensor unit is engaged is provided to the other side portion of the printer, a second latch pawl is provided at the inner edge of the second recess portion, and the first and second recess portions are fitted to the rod-shaped portion from the confronting direction.

8. The printer according to claim 7, wherein one ends of the head unit and the sensor unit are mounted in the printer main body while the rotating centers thereof are displaced from each other, and when the respective units rotates in the same direction interlockingly, the first recess portion is relatively moved along the rod-shaped portion, and the engagement state of the first latch pawl to the first catching portion is released.

9. The printer according to claim 6, further comprising holding means for holding the sensor unit at the non-detection position.

10. The printer according to claim 6, further comprising an urging member for urging the head unit at all times so that the print head is moved from the print position to the evacuated position, and holding the head unit at the evacuated position.

11. The printer according to claim 10, further comprising braking means for braking the head unit when the print head is moved from the print position to the evacuated position by a predetermined angle or more.

12. A printer having a printer main body, a print head for executing a print operation on a sheet loaded in the printer main body, and a sheet sensor for executing a predetermined detecting operation on the sheet, comprising:

a head unit in which the print head is mounted; and a sensor unit in which the sheet sensor is mounted, wherein the print head is movable between a print position at which the print head is in contact with or in proximity to the sheet and an evacuated position at which the print head is spaced from the sheet, the sheet sensor is movable between a detection position at which the sheet sensor is in contact with or in proximity to the sheet and a non-detection position at which the sheet sensor is spaced from the sheet, one end of the head unit is freely rotatably supported at one side portion of the printer main body, and the other end thereof is freely engageable with and disengageable from the sensor unit by first engaging means, one end of the sensor unit is freely rotatably supported at one side portion of the printer main body, and the other end thereof is freely engageable with and disengageable from the printer main body by second engaging means, and the sheet sensor is moved from the detection position to the non-detection position interlockingly with a moving operation of the print head from the print position to the evacuated position, and movable from the non-detection position to the detection position independently of the print head.

13. The printer according to claim 12, wherein the first engaging means comprises a first latch pawl formed in the head unit, and a first catching portion that is formed in the sensor unit and freely engageable with and disengageable from the first latch pawl, the second engaging means comprises a second latch pawl formed in the printer main body, and a second catching portion that is formed in the sensor unit and freely engageable with and disengageable from the second latch pawl, and the latch force of the first latch pawl to the first catching portion is set to be larger than the latch force of the second latch pawl to the second catching portion.

14. The printer according to claim 13, wherein a rod-shaped portion is formed to the other end of the sensor unit so as to extend in the axial direction, the first and second catching portions are formed at different positions of the rod-shaped portion, a first recess portion fitted to the rod-shaped portion is formed at the other end of the head unit, the first latch pawl is formed at the inner edge of the first recess portion, a second recess portion fitted to the rod-shaped portion of the sensor unit is formed at the other side portion of the printer, the second latch pawl is formed at the inner edge of the second recess portion, and the first and second recess portions are fitted to the rod-shaped portion from the respective confronting sides thereof.

15. The printer according to claim 14, wherein the one ends of the head unit and the sensor unit are supported by the printer main body so that the rotational centers thereof are displaced from each other, and when the respective units are interlockingly rotated in the same direction, the first recess portion is relatively moved along the rod-shaped portion, and the fitting state of the first latch pawl to the first catching portion is released.

16. The printer according to claim 12, further comprising holding means for holding the sensor unit at the non-detection position.

17. The printer according to claim 12, further comprising an urging member for urging the head unit at all times so that the print head is moved from the print position to the evacuated position, and holding the head unit at the evacuated position.

18. The printer according to claim 17, further comprising braking means for braking the head unit when the print head is moved from the print position to the evacuated position by a predetermined angle or more.

* * * * *